US008909078B2

(12) United States Patent
Hirota

(10) Patent No.: US 8,909,078 B2
(45) Date of Patent: Dec. 9, 2014

(54) IMAGE FORMING APPARATUS

(75) Inventor: Junichi Hirota, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 175 days.

(21) Appl. No.: 13/314,390

(22) Filed: Dec. 8, 2011

(65) Prior Publication Data

US 2012/0155911 A1 Jun. 21, 2012

(30) Foreign Application Priority Data

Dec. 20, 2010 (JP) ..... 2010-283479

(51) Int. Cl.
*G03G 15/00* (2006.01)

(52) U.S. Cl.
USPC ..... 399/37

(58) Field of Classification Search
USPC ..... 399/10, 37, 88, 89
See application file for complete search history.

(56) References Cited

U.S. PATENT DOCUMENTS

| | | | | |
|---|---|---|---|---|
| 7,555,660 | B2 | 6/2009 | Kamisuwa et al. | |
| 7,877,617 | B2 | 1/2011 | Kaneda | |
| 8,046,613 | B2 | 10/2011 | Enami et al. | |
| 2007/0182998 | A1 | 8/2007 | Okada | |
| 2009/0110427 | A1 * | 4/2009 | Ishizuka | 399/88 |

FOREIGN PATENT DOCUMENTS

| | | | |
|---|---|---|---|
| CN | 101013285 | A | 8/2007 |
| CN | 101059671 | A | 10/2007 |
| CN | 101083703 | A | 12/2007 |
| CN | 101387843 | A | 3/2009 |
| JP | 2002-225395 | A | 8/2002 |
| JP | 2006-039443 | A | 2/2006 |
| JP | 2007-295433 | A | 11/2007 |
| JP | 2007295433 | A * | 11/2007 |
| JP | 2009-107141 | A | 5/2009 |

OTHER PUBLICATIONS

Machine translation of JP 2007295433 A obtained on Oct. 25, 2013.*
Notification of the First Office Action—Chinese Patent Application No. 201110418770.4, State Intellectual Property Office of the Peoples Republic of China, Mar. 5, 2014.
Office Action—Korean Patent Appln. No. 10-2011-0137050, dated Apr. 14, 2014, Korean Patent Office.
Office Action, mailed Sep. 11, 2014, in Japanese Patent Appln. No. 2010-283479, Japanese Patent Office.

* cited by examiner

*Primary Examiner* — Gregory H Curran
(74) *Attorney, Agent, or Firm* — Fitzpatrick, Cella, Harper & Scinto

(57) ABSTRACT

An image forming apparatus having an active mode of performing image formation and an electric power saving mode of reducing electric power consumption, the apparatus including: an electric power measuring portion configured to measure the electric power consumption of the apparatus; a storage portion configured to store electric power consumption information per unit time of the apparatus in the electric power saving mode; and a control portion configured to determine, based on the electric power consumption measured by the electric power measuring portion, consumed electric energy of the apparatus during a period in which the apparatus is in the active mode, and determine, based on a length of period in which the apparatus is in the electric power saving mode and the electric power consumption information stored in the storage portion, consumed electric energy of the apparatus during the period in which the apparatus is in the electric power saving mode.

25 Claims, 11 Drawing Sheets

FIG. 4

| DATE | MODE | PERIOD (TIME AMOUNT) | CONSUMED ELECTRIC ENERGY |
|---|---|---|---|
| OCTOBER 10 | RISING | 10 MINUTES | 500Wh |
| | COPY | 1 HOUR | 1000Wh |
| | PRINT | 2 HOURS | 1300Wh |
| | SCAN | 50 MINUTES | 400Wh |
| | STANDBY | 3 HOURS | 1000Wh |
| | SLEEP | 10 HOURS | 400Wh |
| | TOTAL | 17 HOURS | 4600Wh |

| FIG. 8A | FIG. 8B |
|---|---|

IMAGE FORMING APPARATUS

BACKGROUND OF THE INVENTION

1. Field of the Invention

The invention relates to a technology of measuring consumed electric energy in an image forming apparatus that operates in a plurality of different operation states such as a standby mode and an electric power saving mode.

2. Description of the Related Art

In recent years, there has been a demand for reduction in electric power consumption of electrical apparatuses in response to a request for energy saving. Against the backdrop of this movement, Japanese Patent Application Laid-Open No. 2007-295433 discloses an image forming apparatus in which electric energy information is generated by sampling actually measured values of electric power consumption in a predetermined cycle for each operation mode of the image forming apparatus, and the generated electric energy information is presented to a user. Accordingly, the user can be notified of electric power consumption and total electric power for each operation mode of the image forming apparatus, which can raise the user's awareness of energy saving.

However, conventionally, even in a sleep mode in which a fixing device requiring the largest electric power in the image forming apparatus stops its operation and therefore almost no fluctuation occurs in electric power consumption, actually measured values of the electric power consumption have been sampled in a predetermined cycle similarly to the other operation modes which cause a large fluctuation in electric power consumption. Therefore, the number of sampling times becomes excessively large in the sleep mode, resulting in an excessive amount of processing. Consequently, unnecessary electric power is consumed accordingly.

SUMMARY OF THE INVENTION

In view of the above, the present invention has an object to provide an image forming apparatus in which consumed electric energy information is to be generated, the image forming apparatus being capable of reducing electric power to be required for sampling of measured values of electric power consumption while maintaining accuracy of the consumed electric energy information.

In order to solve the above-mentioned problems, the present invention provides an image forming apparatus having an active mode of performing image formation and an electric power saving mode of reducing electric power consumption, the image forming apparatus including: an electric power measuring portion configured to measure the electric power consumption of the image forming apparatus; a storage portion configured to store electric power consumption information per unit time of the image forming apparatus in the electric power saving mode; and a control portion configured to determine, based on the electric power consumption measured by the electric power measuring portion, consumed electric energy of the image forming apparatus during a period in which the image forming apparatus is in the active mode, and determine, based on a length of period in which the image forming apparatus is in the electric power saving mode and the electric power consumption information stored in the storage portion, consumed electric energy of the image forming apparatus during the period in which the image forming apparatus is in the electric power saving mode.

Further features of the present invention will become apparent from the following description of exemplary embodiments with reference to the attached drawings.

BRIEF DESCRIPTION OF THE DRAWINGS

FIG. 4 is an illustration of an example of display of a time amount and consumed electric energy in each operation mode of the image forming apparatus.

DESCRIPTION OF THE EMBODIMENTS

First Embodiment

Figure 10:
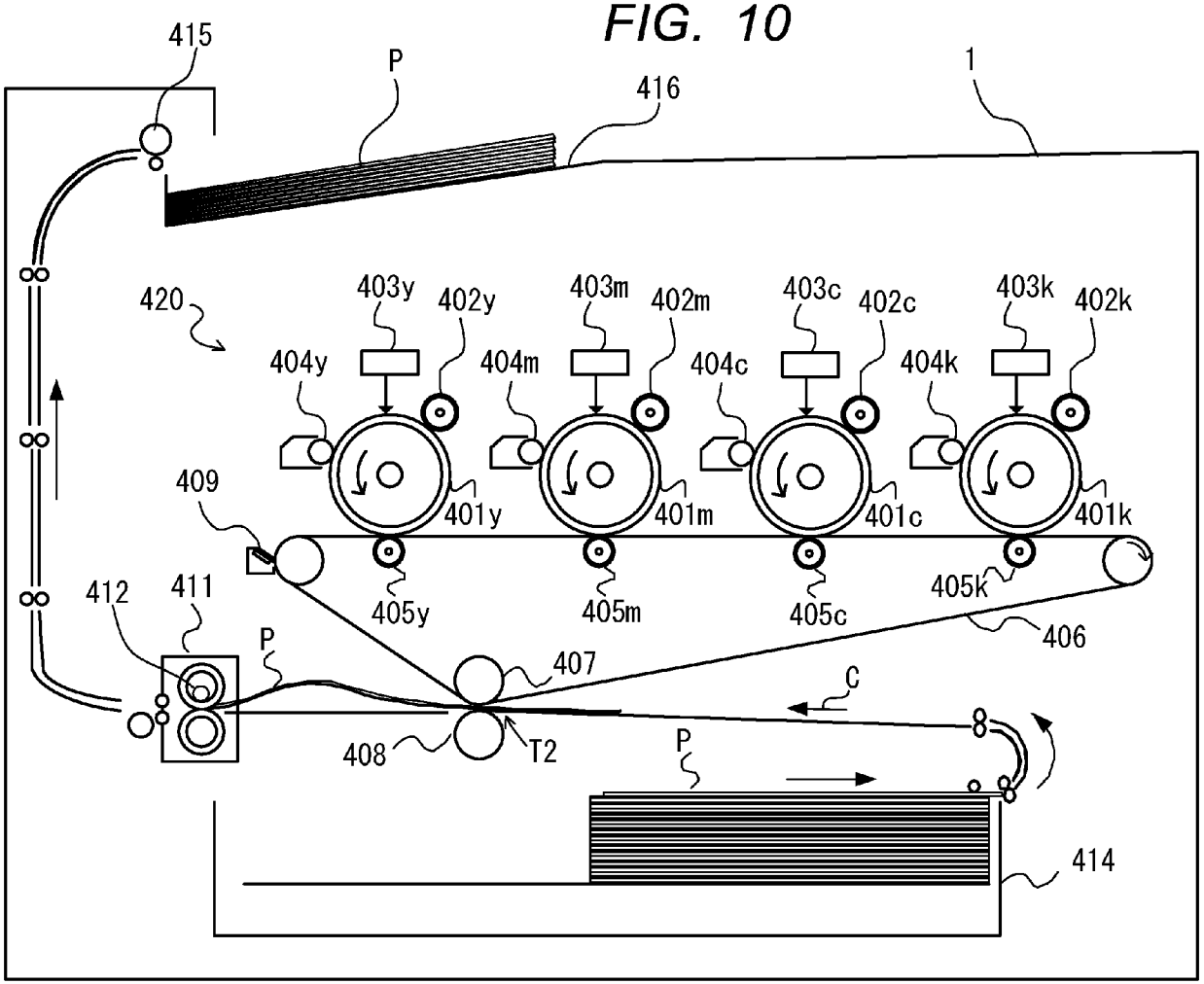
FIG. 10 is a schematic configuration diagram of the image forming apparatus.

Referring to FIG. 10, an image forming apparatus will be described. In FIG. 10, the image forming apparatus 1 includes four photosensitive drums 401 arranged in line. The four photosensitive drums 401 include a photosensitive drum 401*y* for a yellow image, a photosensitive drum 401*m* for a magenta image, a photosensitive drum 401*c* for a cyan image, and a photosensitive drum 401*k* for a black image. In FIG. 10, the four photosensitive drums 401 are rotatable in a counterclockwise direction.

Around the photosensitive drum 401*y*, a charging roller 402*y*, a laser unit (exposure device) 403*y*, a developing sleeve (developing device) 404*y*, and a primary transfer roller (primary transfer device) 405*y* are arranged in the stated order in the rotation direction of the photosensitive drum 401*y*. Similarly, around each of the photosensitive drums 401*m*, 401*c*, and 401*k*, the charging roller 402, the laser unit 403, the developing sleeve 404, and the primary transfer roller 405 are arranged.

Under the four photosensitive drums 401, an intermediate transfer belt (intermediate transfer member) 406 is rotatably provided. The intermediate transfer belt 406 is brought into contact with the photosensitive drums 401 (401*y*, 401*m*, 401*c*, and 401*k*) by the primary transfer rollers 405 (405*y*, 405*m*, 405*c*, and 405*k*). A cleaning device 409 is provided so as to be separable from and in contact with the intermediate transfer belt 406. The cleaning device 409 removes toner remaining on the intermediate transfer belt 406 without being transferred onto a recording material P. On an inner side of the intermediate transfer belt 406, a secondary transfer inner roller 407 is arranged. On an outer side of the intermediate transfer belt 406, a secondary transfer outer roller 408 is arranged. The secondary transfer outer roller 408 is arranged opposite to the secondary transfer inner roller 407 to form a secondary transfer portion T2 between the intermediate transfer belt 406 and the secondary transfer outer roller 408.

In a conveyance direction C of the recording material (hereinafter, referred to as "sheet") P, a fixing device 411 is provided on a downstream side of the secondary transfer portion T2. In a lower part of the image forming apparatus 1, a sheet feeding cassette 414 that contains the sheets P is provided. In an upper part of the image forming apparatus 1, a discharge roller 415 and a discharge tray 416 are provided.

At the time of image formation, the photosensitive drums 401 (401*y*, 401*m*, 401*c*, and 401*k*) are rotated in the counter-clockwise direction. Surfaces of the photosensitive drums 401 (401*y*, 401*m*, 401*c*, and 401*k*) are uniformly charged by the charging rollers 402 (402*y*, 402*m*, 402*c*, and 402*k*), respectively. The uniformly charged surfaces of the photosensitive drums 401 (401*y*, 401*m*, 401*c*, and 401*k*) are exposed to laser beams emitted from the laser units 403 (403*y*, 403*m*, 403*c*, and 403*k*), respectively, to thereby form electrostatic latent images. The electrostatic latent images on the photosensitive drums 401 are developed into developer images (toner images) with developers (hereinafter, referred to as "toners") of the respective colors by the developing sleeves 404 (404*y*, 404*m*, 404*c*, and 404*k*), respectively. Specifically, the electrostatic latent image on the photosensitive drum 401*y* is developed into a yellow developer image (hereinafter, referred to as "yellow toner image") with yellow developer (hereinafter, referred to as "yellow toner") by the developing sleeve 404*y*. The electrostatic latent image on the photosensitive drum 401*m* is developed into a magenta developer image (hereinafter, referred to as "magenta toner image") with magenta developer (hereinafter, referred to as "magenta toner") by the developing sleeve 404*m*. The electrostatic latent image on the photosensitive drum 401*c* is developed into a cyan developer image (hereinafter, referred to as "cyan toner image") with cyan developer (hereinafter, referred to as "cyan toner") by the developing sleeve 404*c*. The electrostatic latent image on the photosensitive drum 401*k* is developed into a black developer image (hereinafter, referred to as "black toner image") with black developer (hereinafter, referred to as "black toner") by the developing sleeve 404*k*.

The yellow toner image, the magenta toner image, the cyan toner image, and the black toner image on the respective photosensitive drums 401 are sequentially transferred onto the intermediate transfer belt 406 by the primary transfer rollers 405 (405*y*, 405*m*, 405*c*, and 405*k*), respectively, while being superimposed on top of each other. Toner remaining on the photosensitive drums 401 without being transferred onto the intermediate transfer belt 406 is removed by cleaning devices (not shown).

Figure 1:
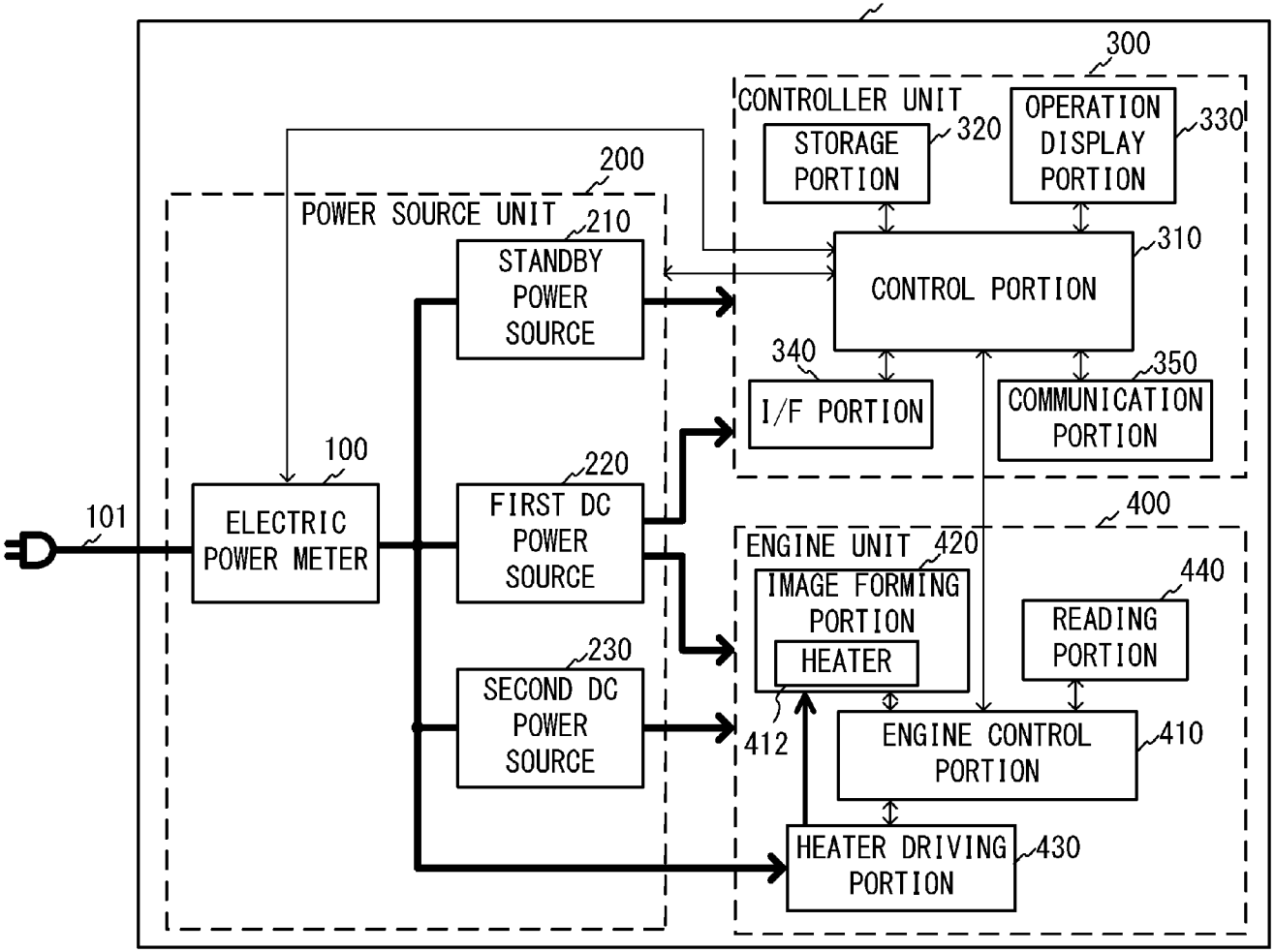
FIG. 1 is a schematic configuration diagram of an image forming apparatus according to a first embodiment of the present invention.

FIG. 1 is a schematic configuration diagram of the image forming apparatus 1 according to a first embodiment. The image forming apparatus 1 has functions of copying, image reading (scanning), printing, network printing, and the like.

In FIG. 1, signal lines are represented by double-headed arrows, and power source lines are represented by thick lines.

The image forming apparatus 1 includes a controller unit 300 which controls operations of the apparatus, an engine unit 400 which performs image reading and image formation, and a power source unit 200 which supplies electric power to the controller unit 300 and the engine unit 400.

The controller unit 300 includes a control portion 310, a storage portion 320, an operation display portion (display portion) 330, an interface portion (hereinafter, referred to as "I/F portion") 340, and a communication portion 350.

The control portion 310 controls operations of the respective portions of the image forming apparatus 1. The storage portion 320 stores various kinds of programs to be executed by the controller unit 300 and sampling results such as measured values and consumed electric energy information. The operation display portion 330 receives job commands to be generated by key operations from a user, and notifies the user of information. The I/F portion 340 exchanges various kinds of data such as job information with an external host such as a personal computer (hereinafter, referred to as "PC"). The communication portion 350 exchanges information with other terminal devices via a network.

The engine unit 400 forms an image on a sheet using an electrophotographic process. The engine unit 400 includes an engine control portion 410, an image forming portion 420 which performs image formation, a heater driving portion 430 which drives a heater 412 of the fixing device 411 which heat-fixes an image on a sheet, and a reading portion 440 which reads an image of an original.

The engine control portion 410 controls operations of the engine unit 400, and exchanges various kinds of information with the control portion 310 to control operation modes and operation timings.

The power source unit 200 includes an electric supply line (hereinafter, referred to as "AC cable") 101, an electric power meter 100, a standby power source 210, a first DC power source 220, and a second DC power source 230. Electric power is supplied from a commercial power source via the AC cable 101 and the electric power meter 100 to the standby power source 210, the first DC power source 220, and the second DC power source 230. Further, electric power is supplied from the commercial power source via the AC cable 101, the electric power meter 100, and the heater driving portion 430 to the heater 412 of the fixing device 411 of the image forming portion 420.

The electric power meter 100 measures electric power consumption of the image forming apparatus 1. The electric power meter 100 includes a voltage measuring portion and a current measuring portion. The voltage measuring portion of the electric power meter 100 measures a voltage of the electric power consumption of the electric power that is supplied from the AC cable 101 to the image forming apparatus 1. The current measuring portion of the electric power meter 100 measures a current of the electric power consumption of the electric power that is supplied from the AC cable 101 to the image forming apparatus 1. The electric power meter 100 is electrically connected to the control portion 310 of the controller unit 300. Measured values (voltage and current) obtained through the measurement by the electric power meter 100 are output to the control portion 310.

The control portion 310 samples the measured values (voltage and current) obtained through the measurement by the electric power meter 100, and stores, in the storage portion 320, electric power obtained by multiplying the voltage and the current together as electric power consumption information. The control portion 310 stores, in the storage portion 320, time information obtained from a clock circuit (not shown) provided in the control portion 310. The control portion 310 determines a period (time amount) of the operation mode based on the time information stored in the storage portion 320. Further, the control portion 310 stores, in the storage portion 320, electric energy obtained by multiplying the electric power consumption information and the time amount together as consumed electric energy information. The control portion 310 may store the measured values (voltage and current) directly in the storage portion 320 instead of the electric power consumption information and the consumed electric energy information.

The storage portion 320 may store, as the result of sampling, the measured values (voltage and current), the electric power consumption information, the time information, the time amount, the consumed electric energy information, and the like.

The standby power source 210 normally operates during a period in which a main power source switch (not shown) of the image forming apparatus 1 is turned ON to supply a DC voltage (for example, 3.3 V) to necessary portions of the controller unit 300.

The first DC power source 220 supplies a DC voltage (for example, 12 V or 5 V) to circuits of signaling systems of the engine unit 400 and the controller unit 300. The second DC power source 230 supplies a DC voltage (for example, 24 V) to driving portions of the engine unit 400. Operations of the respective operations of a plurality of operation modes of the image forming apparatus 1 are described.

(1. Rising Mode)

First, when the main power source switch (not shown) arranged on a side surface of the image forming apparatus 1 is turned ON, electric power is input from the commercial power source via the AC cable to the power source unit 200. The standby power source 210 supplies a DC voltage (for example, 3.3 V) to the controller unit 300.

The control portion 310 processes an initial program for boot-up, and then reads a control program stored in the storage portion 320 to start activation of the entire image forming apparatus 1.

The control portion 310 turns ON the first DC power source 220 to supply a DC voltage to the circuits of the signaling system of the controller unit 300 and the engine unit 400. Subsequently, the control portion 310 turns ON the second DC power source 230 to supply a DC voltage to the driving portions of the engine unit 400.

After that, the control portion 310 transmits a control signal to the engine control portion 410 to cause each portion of the engine unit 400 to perform an initial operation. The control portion 310 causes the engine control portion 410 to drive the heater driving portion 430, to thereby raise the temperature of the heater 412 of the fixing device 411 of the image forming portion 420.

At the same time when the control portion 310 turns ON the second DC power source 230, the control portion 310 recognizes that the operation mode is a "rising mode". When an initial operation of the heater driving portion 430 is performed so that the heater 412 of the fixing device 411 reaches to a target temperature that allows copying and printing to be executed, the "rising mode" is cancelled. At this time, the control portion 310 recognizes that the operation mode is changed from the "rising mode" to a "standby mode".

(2. Copy Mode)

When an original is placed on a platen glass (not shown) of the reading portion 440 and a copy start button (not shown) of the operation display portion 330 is depressed, the control portion 310 detects the start of copying and issues a copy command to the engine control portion 410. As a result, the engine unit 400 forms an image on the sheet P based on image information of the original read by the reading portion 440.

At the same time when the control portion 310 detects the start of copying, the control portion 310 recognizes that the operation mode is a "copy mode". When the copying is completed, the "copy mode" is cancelled.

At this time, the control portion 310 recognizes that the operation mode is changed from the "copy mode" to the "standby mode".

(3. Print Mode)

When the control portion 310 receives a print command and print information from the communication portion 350 or the I/F portion 340, the control portion 310 issues the print command to the engine control portion 410. As a result, the engine unit 400 forms an image on the sheet P based on the print information received from the communication portion 350 or the I/F portion 340.

At the same time when the control portion 310 receives the print command, the control portion 310 recognizes that the operation mode is a "print mode". When the print output is completed, the "print mode" is cancelled. At this time, the control portion 310 recognizes that the operation mode is changed from the "print mode" to the "standby mode".

(4. Scan Mode)

When an original is placed on the platen glass of the reading portion 440, the operation display portion 330 sets a scan mode. When a start button (not shown) is depressed, the control portion 310 detects the start of scanning and issues a scan command to the engine control portion 410. As a result, the engine unit 400 transmits image information of the original read by the reading portion 440 to the controller unit 300. The image information is saved in the storage portion 320.

At the same time when the control portion 310 detects that the start button (not shown) is depressed, the control portion 310 recognizes that the operation mode is the "scan mode". When the scanning is completed, the "scan mode" is cancelled. At this time, the control portion 310 recognizes that the operation mode is changed from the "scan mode" to the "standby mode".

Instead of using the start button, a PC may be used to transmit the command to start scanning via the I/F portion 340 or the communication portion 350.

(5. Standby Mode)

The image forming portion 420 includes the fixing device 411 having the heater 412 arranged inside. For the purpose of energy saving, the fixing device 411 in the standby mode is maintained at a temperature (for example, 170° C.) that is several tens of degrees Celsius lower than the target temperature (for example, 230° C.) for executing copying and printing. Although energy saving is aimed, the fixing device 411 is controlled so that the temperature can be raised to the target temperature that allows copying and printing to be executed immediately when the copy command or the print command is received.

In the standby mode, the second DC power source 230 is turned OFF and hence the motor and the like in the image forming apparatus 1 are stopped.

When the operation mode is changed to the "standby mode", the control portion 310 recognizes that the operation mode is changed to the "standby mode". At the same time when the control portion 310 detects the start of copying or receives the print command in the "standby mode", the control portion 310 recognizes that the operation mode is changed to the "copy mode" or the "print mode".

Note that, during a period between when the control portion 310 detects the start of copying or receives the print command and when the temperature of the fixing device 411 reaches to the target temperature that allows copying and printing to be executed, the control portion 310 operates in the "rising mode".

(6. Sleep Mode)

A sleep mode (electric power saving mode) refers to a mode of reducing the electric power consumption more greatly than in the standby mode.

The sleep mode provides the following state. That is, no control is performed to maintain the temperature of the fixing device 411, and the second DC power source 230 and the first DC power source 220 are turned OFF while the standby power source 210 is turned ON. Further, the operation display portion 330 is also turned OFF.

The first DC power source 220 and the second DC power source 230 are turned OFF and the standby power source 210 is turned ON. Hence, only the controller unit 300 operates. When the control portion 310 receives information such as the print command from the I/F portion 340 or the communication portion 350, the control portion 310 cancels the sleep mode immediately. When the control portion 310 receives the print command, the control portion 310 activates the image forming apparatus 1 to start printing. Further, when an external apparatus requests internal information of the image forming apparatus 1, the control portion 310 transmits the internal information managed by the controller unit 300 to the external apparatus via the I/F portion 340 or the communication portion 350.

When the image forming apparatus 1 in the standby mode is not used for a predetermined period of time, the operation mode is automatically changed from the standby mode to the sleep mode. Alternatively, a power source switch provided on the operation display portion 330 may be depressed to change the operation mode from the standby mode to the sleep mode.

When the operation mode is changed to the sleep mode according to the above-mentioned conditions, the control portion 310 recognizes that the operation mode is changed to the "sleep mode".

The sleep mode is cancelled when any operation is performed for the image forming apparatus 1, when the control portion 310 receives a command or information from the external apparatus via the I/F portion 340 or the communication portion 350, or when the power source switch of the operation display portion 330 is depressed.

When the sleep mode is cancelled according to the above-mentioned conditions, the control portion 310 recognizes that the sleep mode is cancelled.

Note that, during a period between when the sleep mode is cancelled and when the temperature of the fixing device 411 reaches to the target temperature that allows copying and printing to be executed, the control portion 310 operates in the "rising mode".

Next, referring to FIGS. 2 and 3, processing of generating consumed electric energy information of each operation mode of the image forming apparatus 1 according to this embodiment will be described.

In the above-mentioned sections of (1. Rising Mode) to (6. Sleep Mode), the control portion 310 performs the following processing to generate consumed electric energy information of each operation mode.

Figure 2:
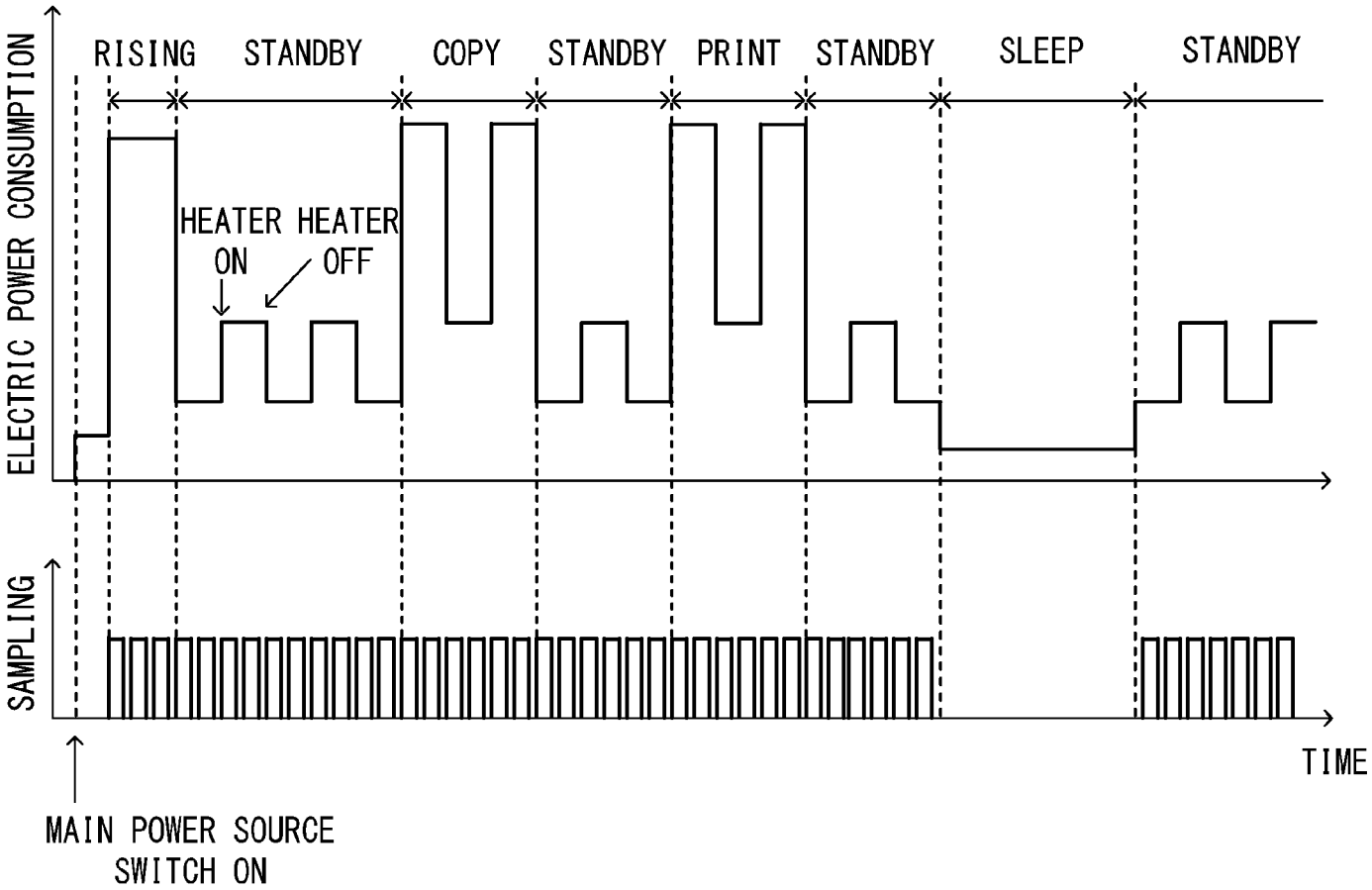
FIG. 2 is a time chart illustrating sampling timings of measured values and electric power consumption of the image forming apparatus according to the first embodiment.

FIG. 2 is a time chart illustrating sampling timings of measured values and electric power consumption of the image forming apparatus 1 according to the first embodiment. FIG. 2 illustrates changes in electric power consumption in each of the plurality of operation modes of the image forming apparatus 1 and sampling timings at which the control portion 310 samples measured values of the electric power meter 100. Note that, in FIG. 2, illustration of the rising mode subsequent to the first standby mode is omitted.

Figure 3:
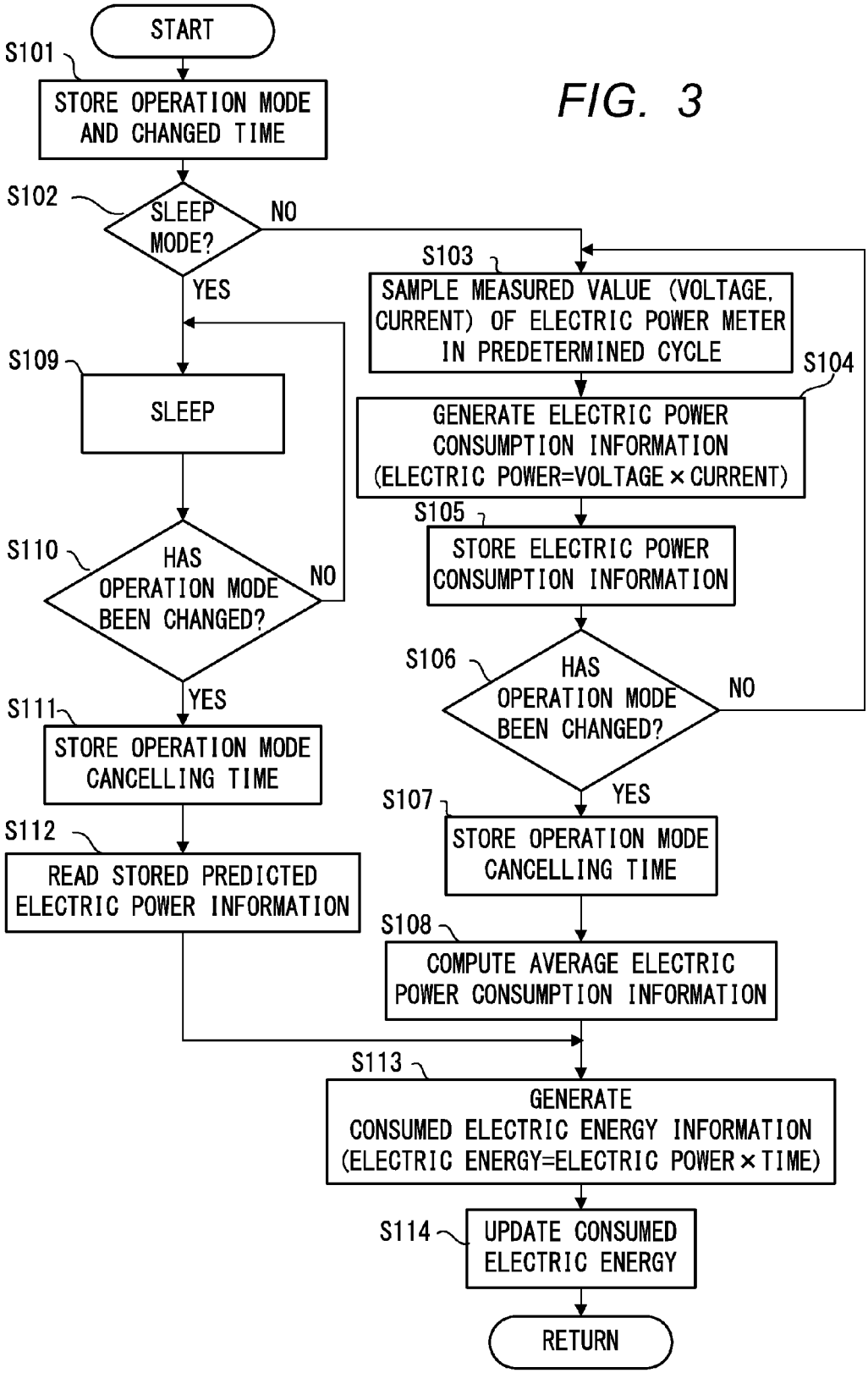
FIG. 3 is a flow chart illustrating an example of processing of generating consumed electric energy information of each operation mode of the image forming apparatus according to the first embodiment.

FIG. 3 is a flow chart illustrating an example of the processing of generating consumed electric energy information of each operation mode of the image forming apparatus according to the first embodiment. Referring to the flow chart of FIG. 3, the processing of generating consumed electric energy information of each operation mode of the image forming apparatus 1, which is performed by the control portion 310, will be described.

When the control portion 310 recognizes that the operation mode of the image forming apparatus 1 is changed, first, the control portion 310 stores a changed operation mode and a changed time in the storage portion 320 (S101).

Subsequently, the control portion 310 determines whether or not the changed operation mode is the sleep mode (electric power saving mode) (S102).

When the changed operation mode is not the sleep mode ("NO" in S102), the control portion 310 samples measured values (voltage and current) of the electric power meter 100 in a predetermined cycle (for example, every 1 second) (S103). The control portion 310 performs an arithmetic operation (voltage×current) on the measured values (voltage and current) to generate electric power consumption information (S104). Specifically, the control portion 310 sets electric power obtained by multiplying the voltage and the current of the electric power meter 100 together as the electric power consumption information. Then, the control portion 310 stores the electric power consumption information in the storage portion 320 (S105). This processing continues ("NO" in S106) until the operation mode is changed.

When the operation mode is changed ("YES" in S106), the control portion 310 proceeds to Step S107, in which the control portion 310 stores an operation mode cancelling time in the storage portion 320 (S107). After that, the control portion 310 averages a plurality of pieces of the electric power consumption information stored in the storage portion 320 to compute average electric power consumption information during the operation mode (S108), and proceeds to Step S113.

In Step S113, the control portion 310 computes a time amount of the operation mode based on the changed time and the cancelling time stored in the storage portion 320. Then, the control portion 310 multiplies the average electric power consumption information and the time amount together to generate consumed electric energy information of the operation mode. The control portion 310 stores the generated consumed electric energy information in the storage portion 320, and updates the consumed electric energy information of the image forming apparatus 1 (S114). After that, the control portion 310 returns to Step S101.

In Step S102, when the changed operation mode is the sleep mode ("YES" in S102), the control portion 310 enters a sleep state in which the control portion 310 does not sample the measured values of the electric power meter 100 (S109). In Step S110, the control portion 310 determines whether or not the sleep mode is changed to another operation mode. When the sleep mode is not changed ("NO" in S110), the control portion 310 maintains the standby state (S109). Specifically, the control portion 310 does not sample the measured values of the electric power meter 100 during the sleep mode. Accordingly, the consumed electric energy of the image forming apparatus 1 to be required for the sampling can be reduced.

When the sleep mode is changed to another operation mode ("YES" in S110), the control portion 310 proceeds to Step S111. In Step S111, the control portion 310 stores a cancelling time of the operation mode (sleep mode) in the storage portion 320. Subsequently, the control portion 310 reads predicted electric power information of the sleep mode that is prestored in the storage portion 320 (S112), and proceeds to Step S113. In the sleep mode, no control is performed to maintain the temperature of the fixing device 411, and hence the electric power consumption of the sleep mode is stable at low level. Therefore, a predicted value of the electric power consumption of the sleep mode is prestored in the storage portion 320 as the predicted electric power information.

In Step S113, the control portion 310 computes a time amount of the sleep mode based on the changed time and the cancelling time stored in the storage portion 320. Then, the control portion 310 multiplies the predicted electric power information and the time amount together to generate consumed electric energy information of the sleep mode (S113). The control portion 310 stores the newly generated consumed electric energy information in the storage portion 320, and updates the consumed electric energy information of the image forming apparatus 1 (S114). After that, the control portion 310 returns to Step S101 and repeats the similar processing.

In this embodiment, the measured values (voltage and current) of the electric power meter 100 are sampled in a cycle of 1 second, but the sampling cycle is not limited to 1 second. The sampling cycle may be shorter than 1 second, for example, 0.1 seconds, or may be longer than 1 second, for example, 3 seconds.

However, when the sampling cycle is set extremely short, processing load on the control portion 310 increases, with the result that the required storage capacity of the storage portion 320 increases. Further, the accuracy of the electric power consumption information to be generated becomes higher, but such accuracy may result in unnecessarily high accuracy. Conversely, when the sampling cycle is set extremely long, the difference between the generated electric power consumption information and the actual electric power consumption may become impermissibly large.

Note that, the control portion 310 may sample the measured values (voltage and current) of the electric power meter 100 in a predetermined cycle and average the measured values when a predetermined number of sampling times is reached. The control portion 310 may compute the electric power consumption information based on averaged measured values and store the computed electric power consumption information in the storage portion 320.

By the time of factory shipment of the image forming apparatus 1, the predicted electric power information of the image forming apparatus 1 in the sleep mode (electric power saving mode) is prestored in the storage portion 320. In the sleep mode, no control is performed on the temperature of the fixing device 411 as described above, and most of the portions of the image forming apparatus 1 stop their operations. Thus, no abrupt fluctuation occurs in electric power consumption of the image forming apparatus 1 and a stable state is ensured, thereby leading to an extremely small error between the predicted electric power information and the electric power consumption information computed based on the actual measured values. Accordingly, the predicted electric power information of the sleep mode can be used for generating the consumed electric energy information of the sleep mode of the image forming apparatus 1.

FIG. 4 is an illustration of an example of display of the time amount and the consumed electric energy in each operation mode of the image forming apparatus 1. The control portion 310 stores, in the storage portion 320, information of the items illustrated in FIG. 4 together with the consumed electric energy information of each operation mode that is obtained through the above-mentioned processing.

The display of the consumed electric energy information of the image forming apparatus 1 illustrated in FIG. 4 is performed regularly or when a command is received from the user. The user can be notified of the consumed electric energy information of the image forming apparatus 1 through the display on the operation display portion 330 or printing on a sheet by the image forming portion 420. Further, the consumed electric energy information of the image forming apparatus 1 may be transmitted to the external apparatus (for example, electric power management apparatus) via the I/F portion 340 or the communication portion 350.

As described above, in this embodiment, in the "operation mode other than the sleep mode (operation mode other than the electric power saving mode)", the control portion 310 samples the measured values of the electric power meter 100 in a predetermined cycle. The control portion 310 generates the consumed electric energy information of the operation mode other than the sleep mode based on the result of sampling. When the image forming apparatus 1 is in the "sleep mode", the control portion 310 does not sample the measured values of the electric power meter 100, and generates the consumed electric energy information of the sleep mode based on the predicted electric power information of the sleep mode prestored in the storage portion 320. Accordingly, according to this embodiment, electric power to be required for executing the conventional processing that has been performed in the sleep mode by the control portion (that is, sampling in a predetermined cycle) can be reduced.

Note that, in this embodiment, the measured values of the electric power meter 100 are not sampled only during the sleep mode and the consumed electric energy information of the sleep mode is computed using the prestored predicted electric power information. However, in the image forming apparatus 1 including the fixing device 411, the consumed electric energy information may be generated using predicted electric power information in another operation mode in which no control is performed on the temperature of the fixing device 411.

Further, in the sleep mode in which the control portion 310 does not sample the measured values of the electric power meter 100, the electric power meter 100 may stop its operation. For example, the electric power supplied to the electric power meter 100 may be shut off. Accordingly, further electric power saving is enabled.

The electric power saving mode is not limited to the sleep mode, and may be another operation mode in which no control is performed on the temperature of the fixing device 411. For example, the electric power saving mode may be an operation mode of making the electric power consumption of the heater driving portion 430 less than the electric power consumption in the modes other than the electric power saving mode.

According to this embodiment, in the image forming apparatus having at least one kind of electric power saving mode, in which the consumed electric energy information is to be generated, the consumed electric energy to be required for the sampling of the measured values of the electric power consumption can be reduced.

Second Embodiment

Hereinafter, a second embodiment of the present invention will be described.

In the first embodiment, the predicted electric power information of the sleep mode is already stored in the storage portion 320 by the time of factory shipment of the image forming apparatus 1. In contrast, in the second embodiment, the control portion 310 samples the measured values of the electric power meter 100 a predetermined number of times (for example, once) after a predetermined period of time Δt (for example, 5 seconds) has elapsed since the change of the operation mode to the sleep mode. The control portion 310 stores, in the storage portion 320, the electric power consumption information computed based on the measured values.

The configuration of the image forming apparatus according to the second embodiment is the same as the configuration according to the above-mentioned first embodiment (FIG. 1), and description thereof is therefore omitted herein.

Next, referring to FIGS. 5 and 6, processing of generating consumed electric energy information of each operation mode of the image forming apparatus 1 according to the second embodiment will be described.

Figure 5:
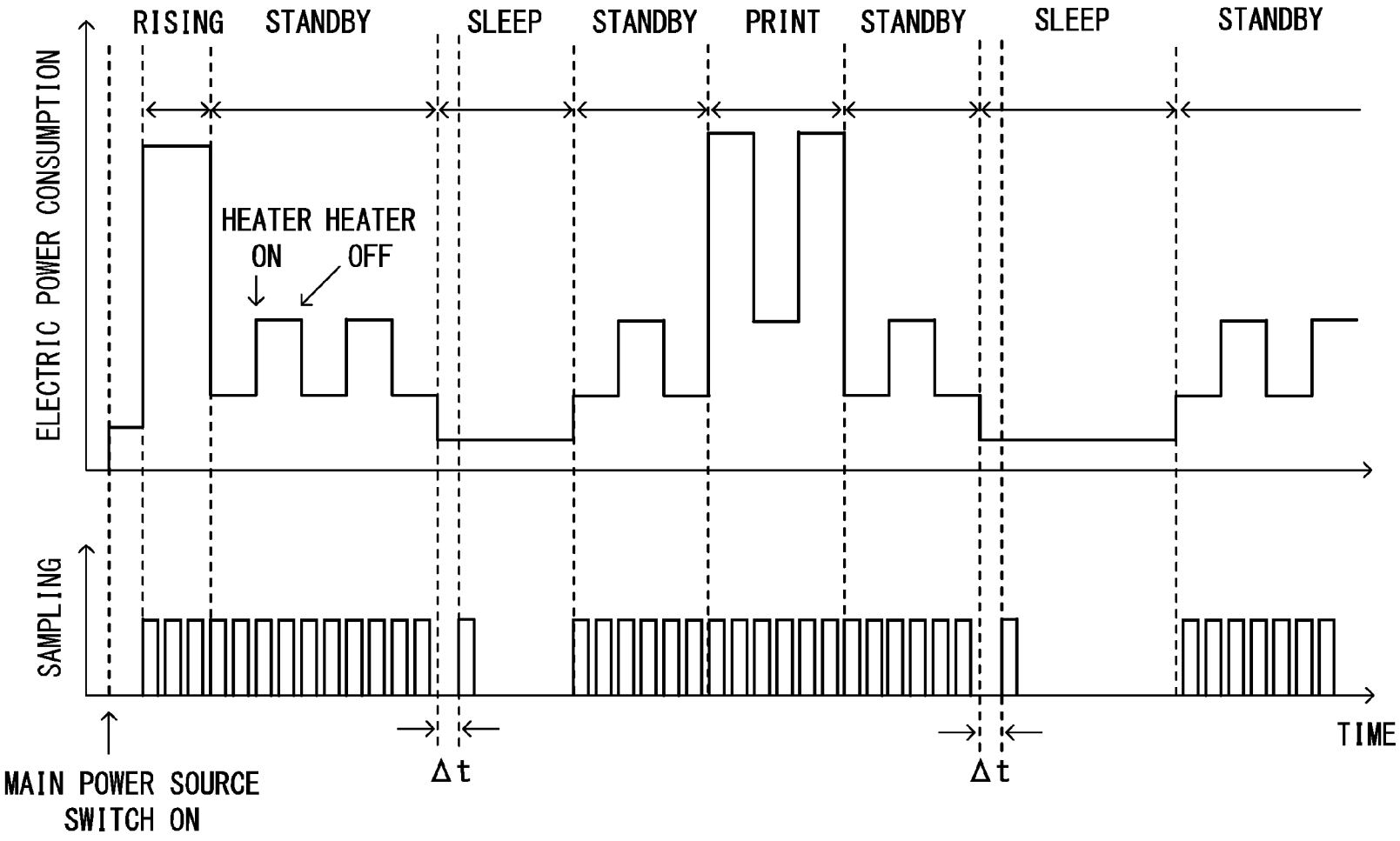
FIG. 5 is a time chart illustrating sampling timings of measured values and electric power consumption of an image forming apparatus according to a second embodiment of the present invention.

FIG. 5 is a time chart illustrating sampling timings of measured values and electric power consumption of the image forming apparatus 1 according to the second embodiment. FIG. 5 illustrates changes in electric power consumption in each of the plurality of operation modes of the image forming apparatus 1 and sampling timings at which the control portion 310 samples measured values of the electric power meter 100. FIG. 6 is a flow chart illustrating an example of the processing of generating consumed electric energy information of each operation mode of the image forming apparatus according to the second embodiment.

The operations in the plurality of operation modes (rising mode, copy mode, print mode, scan mode, standby mode, and sleep mode) of the image forming apparatus 1 according to the second embodiment are the same as the operations according to the above-mentioned first embodiment, and description thereof is therefore omitted herein.

Further, the processing in the case of the "operation mode other than the sleep mode (electric power saving mode)" (processing in the case of "NO" in S202) according to the second embodiment is the same as the processing according to the first embodiment (processing in the case of "NO" in S102), and description thereof is therefore omitted herein. Specifically, the processing of S203, S204, S205, S206, S207, and S208 of FIG. 6 is the same as the processing of S103, S104, S105, S106, S107, and S108 of FIG. 3, and description thereof is therefore omitted herein.

Thus, processing of generating consumed electric energy information for the "sleep mode" of the image forming apparatus 1 of this embodiment will be described herein.

When the control portion 310 recognizes that the operation mode of the image forming apparatus 1 is changed, first, the control portion 310 stores a changed operation mode and a changed time in the storage portion 320 (S201).

Subsequently, the control portion 310 determines whether or not the changed operation mode is the sleep mode (S202).

When the changed operation mode is the sleep mode ("YES" in S202), the control portion 310 samples the measured values (voltage and current) of the electric power meter 100 the predetermined number of times after the predetermined period of time Δt (for example, 5 seconds) has elapsed since the start of the sleep mode (S209). The predetermined number of times is smaller (for example, one) than the number of sampling times (for example, five) in the case where the measured values are sampled in a predetermined cycle (for example, every 1 second) within the predetermined period of time Δt (for example, 5 seconds) in the "operation mode other than the sleep mode". In this embodiment, the control portion 310 samples the measured values of the electric power meter 100 once.

The control portion 310 performs an arithmetic operation (voltage×current) on the measured values (voltage and current) to generate electric power consumption information (S210). Specifically, the control portion 310 sets electric power obtained by multiplying the voltage and the current of the electric power meter 100 together as the electric power consumption information. Then, the control portion 310 stores the electric power consumption information in the storage portion 320 (S211).

After that, the control portion 310 enters the sleep state in which the control portion 310 does not sample the measured values of the electric power meter 100 (S212). In Step S213, the control portion 310 determines whether or not the sleep mode is changed to another operation mode. When the sleep mode is not changed ("NO" in S213), the control portion 310 maintains the standby state (S212). Specifically, after the sampling of the predetermined number of times in the sleep mode, the control portion 310 does not sample the measured values of the electric power meter 100 until the sleep mode is changed to another operation mode. Accordingly, the consumed electric energy of the image forming apparatus 1 to be required for the sampling can be reduced. Further, during the period in which the control portion 310 does not sample the measured values of the electric power meter 100, the electric power meter 100 may stop its operation. For example, the electric power supplied to the electric power meter 100 may be shut off. Accordingly, further electric power saving is enabled.

When the sleep mode is changed to another operation mode ("YES" in S213), the control portion 310 proceeds to Step S214. In Step S214, the control portion 310 stores a cancelling time of the operation mode (sleep mode) in the storage portion 320. Subsequently, the control portion 310 reads the electric power consumption information that has been stored in the storage portion 320 in S211 (S215), and proceeds to Step S216.

In Step S216, the control portion 310 computes a time amount of the sleep mode based on the changed time and the cancelling time stored in the storage portion 320. Then, the control portion 310 multiplies the electric power consumption information and the time amount together to generate consumed electric energy information of the sleep mode (S216). The control portion 310 stores the generated consumed electric energy information in the storage portion 320, and updates the consumed electric energy information of the image forming apparatus 1 (S217). After that, the control portion 310 returns to Step S201 and repeats the similar processing.

In this embodiment, the measured values of the electric power meter 100 are sampled once after 5 seconds have elapsed since the change of the operation mode to the sleep mode. However, the predetermined period of time Δt between when the operation mode is changed to the sleep mode and when the sampling is started is not limited to 5 seconds, and may be, for example, 3 seconds or 10 seconds.

Similarly, the number of sampling times is not limited to one, and may be, for example, three or five. Then, the electric power consumption information in the sleep mode may be computed based on an average value of three or five sets of measured values and the computed electric power consumption information may be stored in the storage portion 320.

The control portion 310 stores, in the storage portion 320, the consumed electric energy information of each operation mode obtained through the above-mentioned processing as the consumed electric energy information illustrated in FIG. 4. Similarly to the first embodiment, the consumed electric energy information of the image forming apparatus 1 may be displayed on the operation display portion 330, printed on a sheet by the image forming portion 420, or transmitted to the external apparatus via the I/F portion 340 or the communication portion 350.

As described above, in this embodiment, the control portion 310 in the sleep mode samples the measured values (voltage and current) of the electric power meter 100 the predetermined number of times after the predetermined period of time Δt has elapsed since the start of the sleep mode. The control portion 310 computes the electric power consumption information based on the sampled measured values, and generates the consumed electric energy information of the sleep mode based on the computed electric power consumption information. The predetermined number of times is smaller than the number of sampling times in the case where the sampling is performed in the predetermined cycle within the predetermined period of time in the "operation mode other than the sleep mode". After the sampling of the predetermined number of times in the sleep mode, the control portion 310 does not sample the measured values of the electric power meter 100 until the sleep mode is ended.

Accordingly, according to this embodiment, electric power to be required for executing the conventional processing that has been performed in the sleep mode by the control portion (that is, sampling in a predetermined cycle) can be reduced. Further, in this embodiment, the consumed electric energy information can be generated with higher accuracy than in the first embodiment that employs the predicted electric power information of the sleep mode.

Specifically, the accuracy of the consumed electric energy information in the second embodiment becomes higher than in the first embodiment for the following reason.

The image forming apparatus 1 is constructed of many mechanical components and electrical components. The individual components each have slight individual differences despite the same type of components. Further, the properties of some components are changeable depending on an installation environment (temperature, humidity, and the like) and an operation status (temperature rise) of the image forming apparatus 1. Thus, the respective units and the apparatus main body of the image forming apparatus 1 that are constructed of those components also have individual differences among the image forming apparatuses 1. As a result, the electric power consumption of the image forming apparatus 1 has an individual difference, and is thus uneven in some degree among the image forming apparatuses 1.

Further, the controller unit 300 may be extended with an option board. The option board includes, for example, a board for extending a storage capacity and a board for extending a network function. Adding an option board results in an increase in current to be required for the controller unit 300, and hence the electric power consumption of the controller unit 300 increases and decreases depending on the presence and absence of the option board.

Further, for example, there is such a case that the image forming apparatus 1 and other electrical apparatuses are supplied with electric power from a single commercial power source. In this case, when the current to be required for the electrical apparatus abruptly increases, the voltage drop increases in an electric power system which supplies electric power to the image forming apparatus 1 and the electrical apparatuses. Due to the voltage drop, the input voltage of the image forming apparatus 1 decreases slightly.

According to the second embodiment, even in the case where the electric power consumption is uneven due to the individual difference among the image forming apparatuses 1, the case where the electric power consumption changes due to the addition or removal of the option board, or the case where the input voltage decreases slightly, the consumed electric energy information can be generated with higher accuracy. In the second embodiment, the electric power of the sleep mode is actually measured, and hence an error in electric power consumption information can be reduced. Accordingly, the consumed electric energy information can be generated with higher accuracy.

Note that, in this embodiment, the measured values of the electric power meter 100 are sampled the predetermined number of times after the predetermined period of time has elapsed since the change of the operation mode to the sleep mode, and the consumed electric energy information of the sleep mode is generated using the electric power consumption information computed based on the measured values. However, in the image forming apparatus 1 including the fixing device 411, also in another operation mode in which no control is performed on the temperature of the fixing device 411, the measured values may be sampled the predetermined number of times after the predetermined period of time has elapsed since the change of the mode. Then, the consumed electric energy information may be generated using the electric power consumption information computed based on the measured values. By reducing the number of sampling times of the measured values in the operation mode as compared to the conventional number of sampling times in a predetermined cycle, the electric power consumption of the image forming apparatus 1 can be reduced.

The electric power saving mode is not limited to the sleep mode, and may be another operation mode in which no control is performed on the temperature of the fixing device 411.

According to this embodiment, in the image forming apparatus having at least one kind of electric power saving mode, in which the consumed electric energy information is to be generated, the consumed electric energy to be required for the sampling of the measured values of the electric power consumption can be reduced.

Third Embodiment

Hereinafter, a third embodiment of the present invention will be described.

In the first embodiment, the predicted electric power information of the sleep mode is prestored in the storage portion 320 by the time of factory shipment of the image forming apparatus 1. In contrast, in the third embodiment, the control portion 310 samples the measured values of the electric power meter 100 a predetermined number of times (for example, once) after a predetermined period of time Δt (for example, 5 seconds) has elapsed since the change of the operation mode to the sleep mode for the first time after the main power source of the image forming apparatus 1 is turned ON. The control portion 310 stores, in the storage portion 320, the electric power consumption information computed based on the measured values.

In the second embodiment, the control portion 310 samples the measured values of the electric power meter 100 the predetermined number of times after the predetermined period of time Δt has elapsed since the sleep mode was started every time the operation mode was changed to the sleep mode. In contrast, in the third embodiment, the control portion 310 samples the measured values of the electric power meter 100 a predetermined number of times (for example, once) when the operation mode is changed to the sleep mode for the first time after the main power source of the image forming apparatus 1 is turned ON. The control portion 310 does not sample the measured values of the electric power meter 100 in the second and subsequent sleep modes after the main power source of the image forming apparatus 1 is turned ON.

The configuration of the image forming apparatus according to the third embodiment is the same as the configuration according to the above-mentioned first embodiment (FIG. 1), and description thereof is therefore omitted herein.

Next, referring to FIGS. 7, 8A and 8B, processing of generating consumed electric energy information of each operation mode of the image forming apparatus 1 according to the third embodiment will be described.

Figure 7:
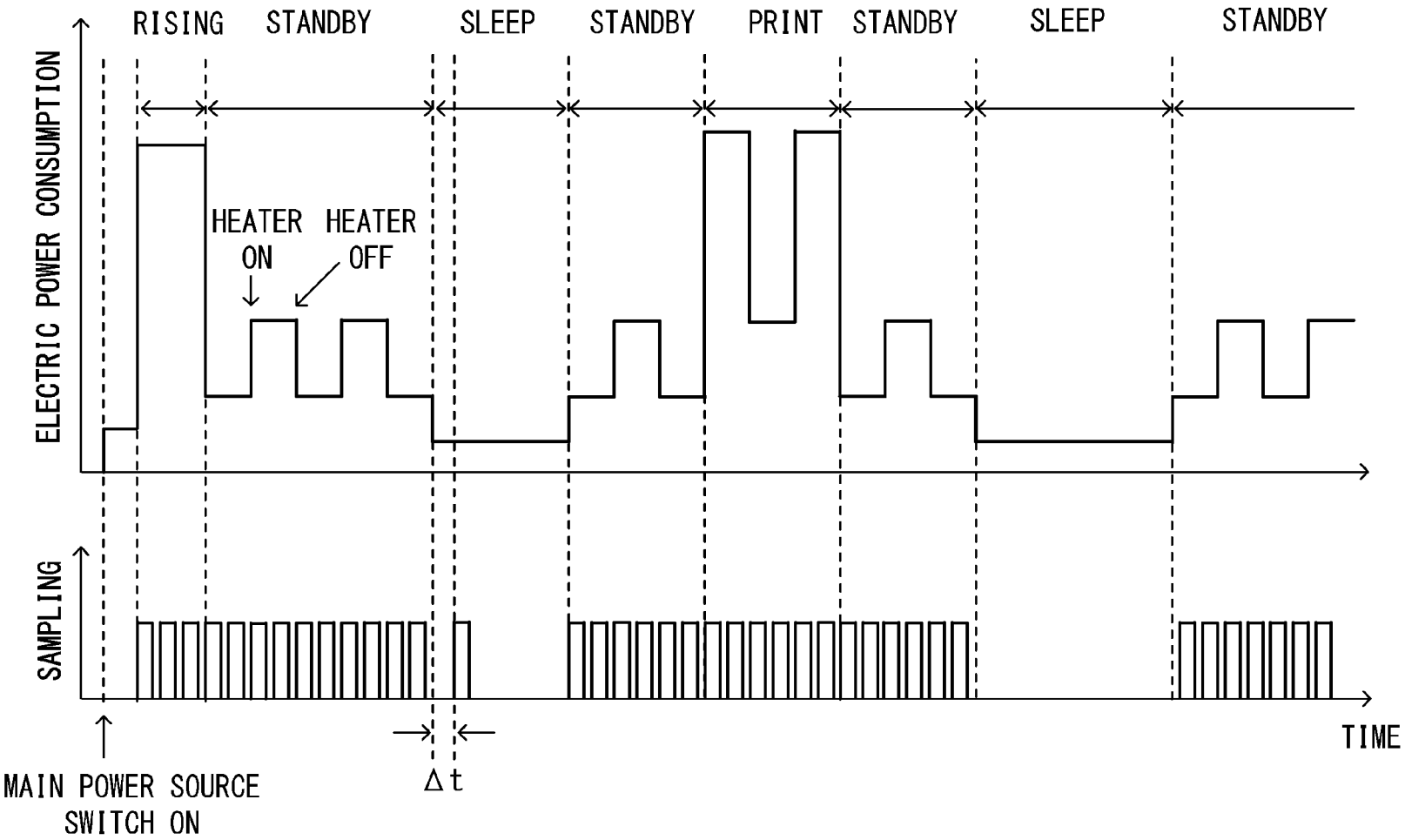
FIG. 7 is a time chart illustrating sampling timings of measured values and electric power consumption of an image forming apparatus according to a third embodiment of the present invention.
Figures 8, 8A:
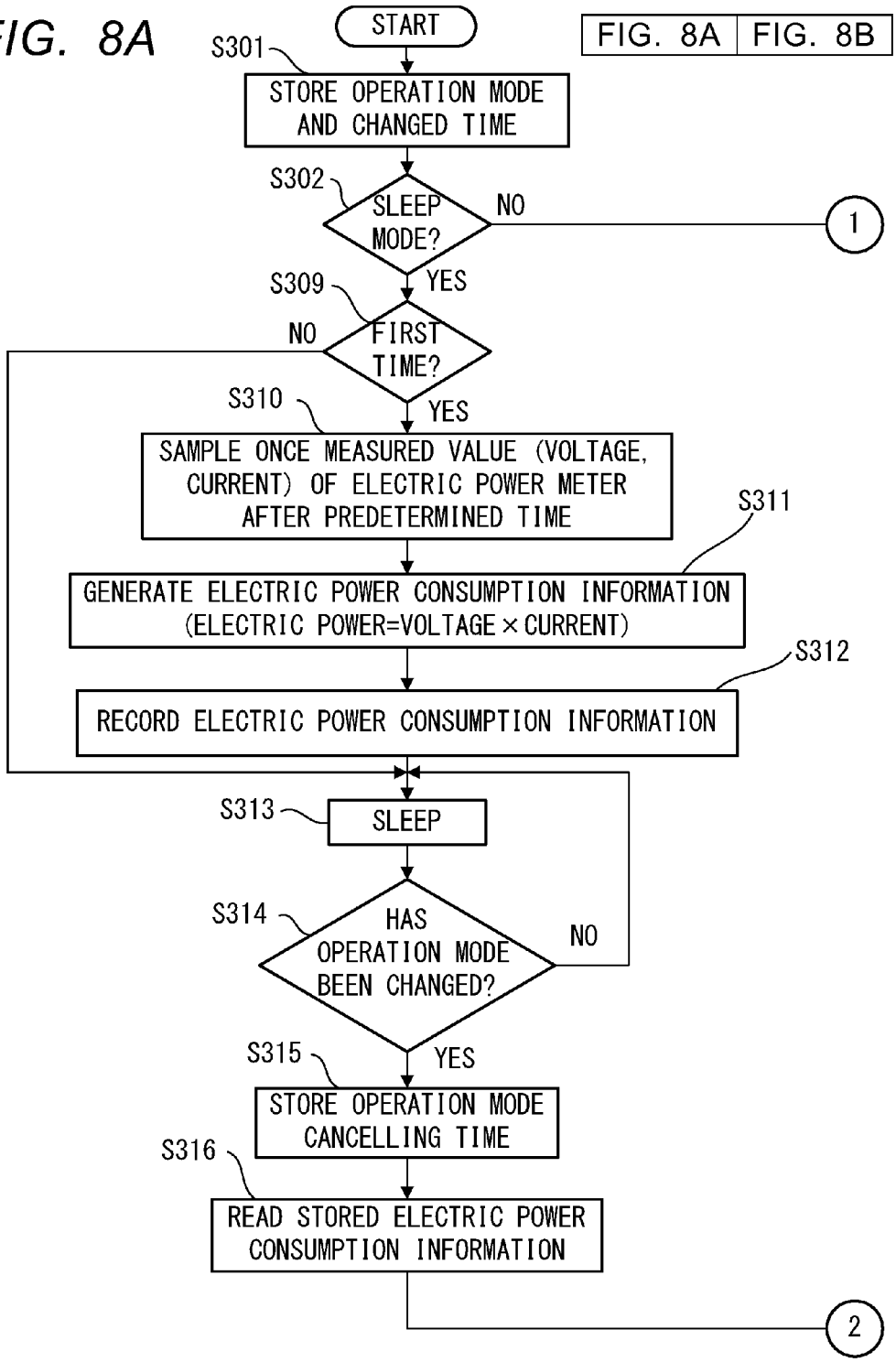
FIG. 8 is comprised of FIGS. 8A and 8B showing flow charts illustrating an example of processing of generating consumed electric energy information of each operation mode of the image forming apparatus according to the third embodiment.
Figure 8B:
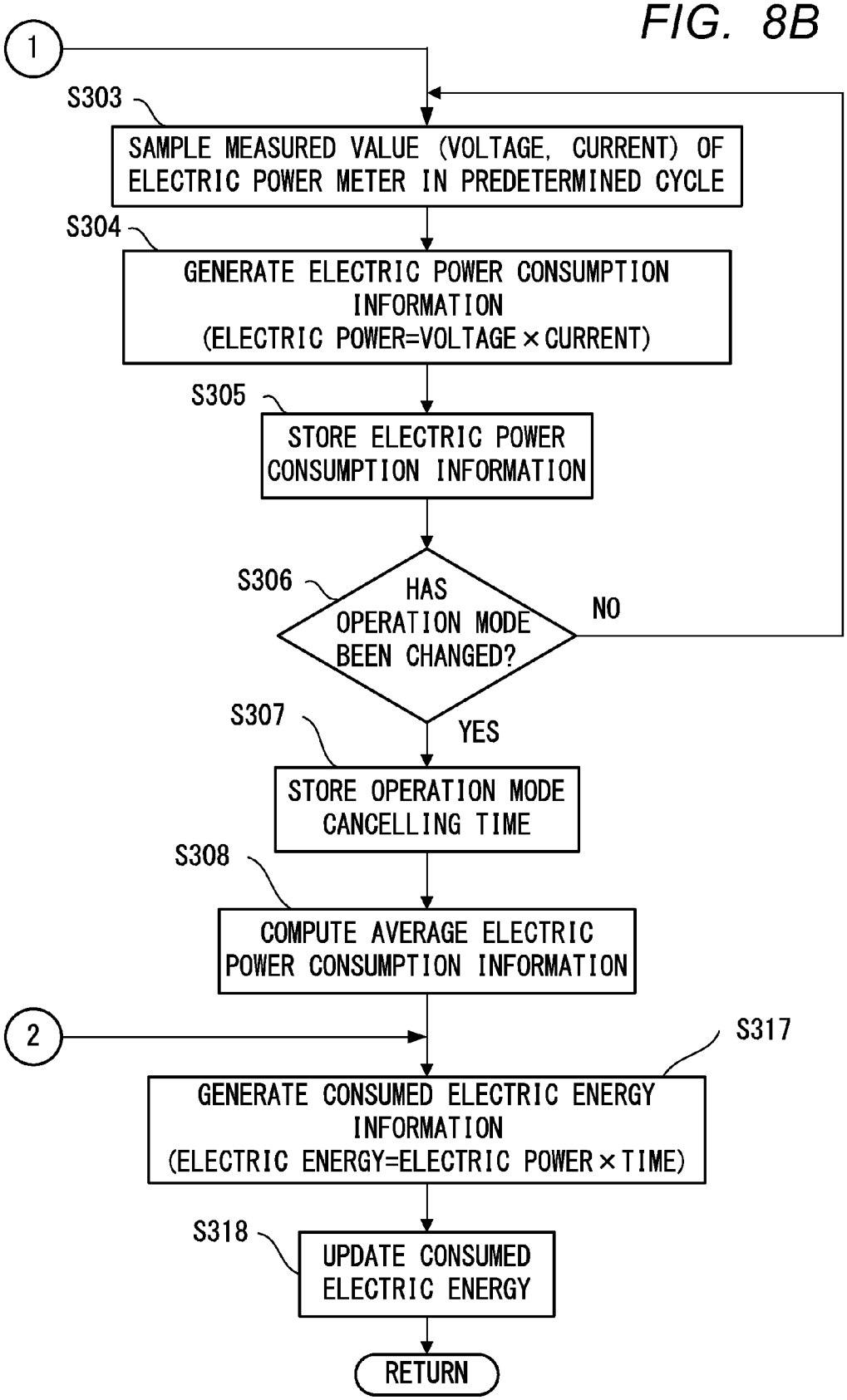

FIG. 7 is a time chart illustrating sampling timings of measured values and electric power consumption of the image forming apparatus 1 according to the third embodiment. FIG. 7 illustrates changes in electric power consumption in each of the plurality of operation modes of the image forming apparatus 1 and sampling timings at which the control portion 310 samples measured values of the electric power meter 100. FIG. 8 is composed of FIGS. 8A and 8B showing flow charts illustrating an example of the processing of generating consumed electric energy information of each operation mode of the image forming apparatus 1 according to the third embodiment.

The operations in the plurality of operation modes (rising mode, copy mode, print mode, scan mode, standby mode, and sleep mode) of the image forming apparatus 1 according to the third embodiment are the same as the operations according to the above-mentioned first embodiment, and description thereof is therefore omitted herein.

Further, the processing in the case of the "operation mode other than the sleep mode (electric power saving mode)" (processing in the case of "NO" in S302) according to the third embodiment is the same as the processing according to the first embodiment (processing in the case of "NO" in S102), and description thereof is therefore omitted herein. Specifically, the processing of S303, S304, S305, S306, S307, and S308 of FIG. 8B is the same as the processing of S103, S104, S105, S106, S107, and S108 of FIG. 3, and description thereof is therefore omitted herein.

Thus, processing of generating consumed electric energy information for the "sleep mode" of the image forming apparatus 1 of this embodiment will be described herein.

When the control portion 310 recognizes that the operation mode of the image forming apparatus 1 is changed, first, the control portion 310 stores a changed operation mode and a changed time in the storage portion 320 (S301).

Subsequently, the control portion 310 determines whether or not the changed operation mode is the sleep mode (S302).

When the changed operation mode is the sleep mode ("YES" in S302), the control portion 310 determines whether or not the present sleep mode is the first sleep mode after the main power source of the image forming apparatus 1 is turned ON (S309).

When the present sleep mode is the first sleep mode after the main power source of the image forming apparatus 1 is turned ON ("YES" in S309), the control portion 310 proceeds to Step S310. In Step S310, the control portion 310 samples the measured values (voltage and current) of the electric power meter 100 the predetermined number of times after the predetermined period of time Δt (for example, 5 seconds) has elapsed since the start of the sleep mode.

Similarly to the second embodiment, the predetermined number of times is smaller (for example, one) than the number of sampling times (for example, five) in the case where the measured values are sampled in a predetermined cycle (for example, every 1 second) within the predetermined period of time Δt (for example, 5 seconds) in the "operation mode other than the sleep mode". In this embodiment, the control portion 310 samples the measured values of the electric power meter 100 once.

The control portion 310 performs an arithmetic operation (voltage×current) on the measured values (voltage and current) to generate electric power consumption information (S311). Specifically, the control portion 310 sets electric power obtained by multiplying the voltage and the current of the electric power meter 100 together as the electric power consumption information. Then, the control portion 310 stores the electric power consumption information in the storage portion 320 (S312).

After that, the control portion 310 enters the sleep state in which the control portion 310 does not sample the measured values of the electric power meter 100 (S313). In Step S314, the control portion 310 determines whether or not the sleep mode is changed to another operation mode. When the sleep mode is not changed ("NO" in S314), the control portion 310 maintains the standby state (S313). Specifically, after the sampling of the predetermined number of times in the sleep mode, the control portion 310 does not sample the measured values of the electric power meter 100 until the sleep mode is changed to another operation mode. Accordingly, the consumed electric energy of the image forming apparatus 1 to be required for the sampling can be reduced. Further, during the period in which the control portion 310 does not sample the measured values of the electric power meter 100, the electric power meter 100 may stop its operation. For example, the electric power supplied to the electric power meter 100 may be shut off. Accordingly, further electric power saving is enabled.

On the other hand, in a case of "NO" in Step S309, that is, when the present sleep mode is one of the second and subsequent sleep modes after the main power source of the image forming apparatus 1 is turned ON, the control portion 310 proceeds to Step S313.

During a period between when the sleep mode is started and when the sleep mode is changed to another operation mode ("YES" in S314), the control portion 310 enters the standby state in which the control portion 310 does not sample the measured values of the electric power meter 100 ("NO" in S314, S313). Specifically, the control portion 310 does not sample the measured values of the electric power meter 100 in the second and subsequent sleep modes after the main power source of the image forming apparatus 1 is turned ON. Accordingly, the consumed electric energy of the image forming apparatus 1 to be required for the sampling can be reduced.

When the sleep mode is changed to another operation mode ("YES" in S314), the control portion 310 proceeds to Step S315. In Step S315, the control portion 310 stores a cancelling time of the operation mode (sleep mode) in the storage portion 320. Subsequently, the control portion 310 reads the electric power consumption information that has been stored in the storage portion 320 in Step S312 (S316), and proceeds to Step S317.

In Step S317, the control portion 310 computes a time amount of the sleep mode based on the changed time and the cancelling time stored in the storage portion 320. Then, the control portion 310 multiplies the electric power consumption information and the time amount together to generate consumed electric energy information of the sleep mode (S317). The control portion 310 stores the generated consumed electric energy information in the storage portion 320, and updates the consumed electric energy information of the image forming apparatus 1 (S318). After that, the control portion 310 returns to Step S301 and repeats the similar processing.

In this embodiment, in the first sleep mode after the main power source of the image forming apparatus 1 is turned ON, the measured values of the electric power meter 100 are sampled once after 5 seconds have elapsed since the start of the sleep mode, and in the second and subsequent sleep modes, the sampling is not performed. However, in the first sleep mode after the main power source of the image forming apparatus 1 is turned ON, the predetermined period of time Δt between when the sleep mode is started and when the sampling is started is not limited to 5 seconds, and may be, for example, 3 seconds or 10 seconds.

Similarly, the number of sampling times is not limited to one, and may be, for example, three or five. Then, the electric power consumption information in the sleep mode may be computed based on an average value of three or five sets of measured values and the computed electric power consumption information may be stored in the storage portion 320.

The control portion 310 stores, in the storage portion 320, the consumed electric energy information of each operation mode obtained through the above-mentioned processing as the consumed electric energy information illustrated in FIG. 4. Similarly to the first embodiment, the consumed electric energy information of the image forming apparatus 1 may be displayed on the operation display portion 330, printed on a sheet by the image forming portion 420, or transmitted to the external apparatus via the I/F portion 340 or the communication portion 350.

As described above, in this embodiment, in the first sleep mode after the main power source of the image forming apparatus 1 is turned ON, the measured values (voltage and current) of the electric power meter 100 are sampled the predetermined number of times after the predetermined period of time Δt has elapsed since the start of the sleep mode, and in the second and subsequent sleep modes, the sampling is not performed. The control portion 310 computes the electric power consumption information based on the sampled measured values, and generates the consumed electric energy information of the sleep mode based on the computed electric power consumption information. The predetermined number of times is smaller than the number of sampling times in the case where the sampling is performed in the predetermined cycle within the predetermined period of time Δt in the "operation mode other than the sleep mode". Accordingly, according to this embodiment, electric power to be required for executing the conventional processing that has been performed in the sleep mode by the control portion (that is, sampling in a predetermined cycle) can be reduced. Further, according to the third embodiment, the electric power consumption of the sleep mode is actually measured similarly to the second embodiment, and hence the consumed electric energy information can be generated with higher accuracy than in the first embodiment that employs the predicted electric power information for computing the consumed electric energy information of the sleep mode.

In this embodiment, the control portion 310 does not sample the measured values of the electric power meter 100 in the second and subsequent sleep modes after the main power source of the image forming apparatus 1 is turned ON. The control portion 310 computes the consumed electric energy information of the second and subsequent sleep modes using the electric power consumption information obtained in the first sleep mode. Accordingly, according to the third embodiment, the consumed electric energy of the image forming apparatus 1 to be required for the sampling can be made less than in the second embodiment in which the measured values are sampled once every time the operation mode is changed to the sleep mode.

Note that, in this embodiment, only in the first sleep mode of the plurality of sleep modes changed after the main power source of the image forming apparatus 1 is turned ON, the measured values of the electric power meter 100 are sampled the predetermined number of times after the predetermined period of time has elapsed since the start of the sleep mode. However, also in another operation mode in which no control is performed on the temperature of the fixing device 411 in the image forming apparatus 1 including the fixing device 411, the measured values may similarly be sampled the predetermined number of times after the predetermined period of time has elapsed only in the first operation mode after the main power source of the image forming apparatus 1 is turned ON. Then, the consumed electric energy information of the second and subsequent operation modes may be generated using the electric power consumption information computed based on the measured values. By reducing the number of sampling times of the measured values in the operation mode as compared to the conventional number of sampling times in a predetermined cycle, the electric power consumption of the image forming apparatus 1 can be reduced.

The electric power saving mode is not limited to the sleep mode, and may be another operation mode in which no control is performed on the temperature of the fixing device 411.

According to this embodiment, in the image forming apparatus having at least one kind of electric power saving mode, in which the consumed electric energy information is to be generated, the consumed electric energy to be required for the sampling of the measured values of the electric power consumption can be reduced.

Fourth Embodiment

Hereinafter, a fourth embodiment of the present invention will be described.

The fourth embodiment is different from the above-mentioned first to third embodiments in that the image forming apparatus 1 of the fourth embodiment includes two AC cables. As is well known, in Japan, the current obtained from the general commercial 100-volt (V) AC power source socket via one line cord is limited to 15 amperes (A). Therefore, two AC cables are, in some cases, provided for the image forming apparatus 1 that requires a current of 15 amperes (A) or more.

Further, the second AC cable is, in some cases, provided so as to keep an environmental heater 450 in operation even when the main power source of the image forming apparatus 1 is turned OFF. As the environmental heater 450, for example, there is a cassette heater which heats the inside of the sheet feeding cassette 414. Even in a case where the image forming apparatus 1 is installed in a high-humidity environment, the cassette heater heats the inside of the sheet feeding cassette 414 so that the sheets contained in the sheet feeding cassette 414 inside the engine unit 400 do not adhere to each other due to the high humidity.

Figure 9:
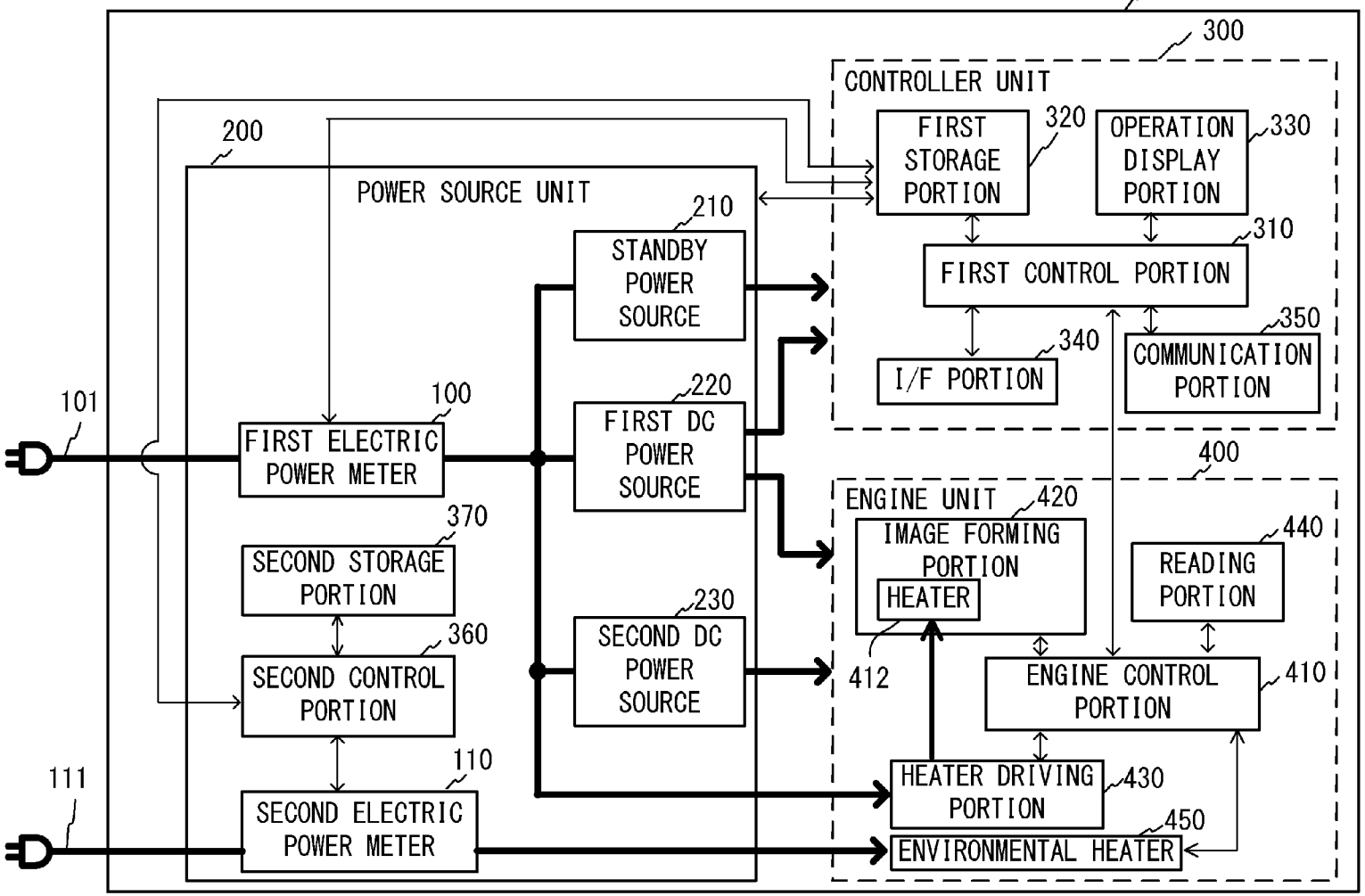
FIG. 9 is a schematic configuration diagram of an image forming apparatus according to a fourth embodiment of the present invention.

FIG. 9 is a schematic configuration diagram of the image forming apparatus 1 according to the fourth embodiment.

The same components as the components of the first embodiment illustrated in FIG. 1 are represented by the same reference symbols, and description thereof is therefore omitted herein. Note that, the electric power meter 100 of FIG. 1 corresponds to a first electric power meter (first electric power measuring portion) 100 of FIG. 9. The AC cable 101 of FIG.

1 corresponds to a first AC cable (first electric supply line) 101 of FIG. 9. The storage portion 320 of FIG. 1 corresponds to a first storage portion 320 of FIG. 9. The control portion 310 of FIG. 1 corresponds to a first control portion 310 of FIG. 9.

The first electric power meter 100 measures the electric power consumption of the electric power that is supplied from the first AC cable 101 to the image forming apparatus 1.

Electric power is supplied from the commercial power source via a second AC cable (second electric supply line) 111 and a second electric power meter (second electric power measuring portion) 110 to the environmental heater 450 of the engine unit 400.

The second electric power meter 110 measures the electric power consumption of the electric power that is supplied from the second AC cable 111 to the image forming apparatus 1. The second electric power meter 110 includes a voltage measuring portion and a current measuring portion.

The voltage measuring portion of the second electric power meter 110 measures a voltage of the electric power consumption of the electric power that is supplied from the second AC cable 111 to the image forming apparatus 1. The current measuring portion of the second electric power meter 110 measures a current of the electric power consumption of the electric power that is supplied from the second AC cable 111 to the image forming apparatus 1. The second electric power meter 110 is electrically connected to a second control portion 360. Measured values (voltage and current) obtained through the measurement by the second electric power meter 110 are output to the second control portion 360.

The second control portion 360 samples the measured values (voltage and current) obtained through the measurement by the second electric power meter 110, and stores, in a second storage portion 370, electric power obtained by multiplying the voltage and the current together as electric power consumption information. The second control portion 360 stores, in the second storage portion 370, time information obtained from a clock circuit (not shown) provided in the second control portion 360. The second control portion 360 determines a period (time amount) of the operation mode based on the time information stored in the second storage portion 370. Further, the second control portion 360 stores, in the second storage portion 370, electric energy obtained by multiplying the electric power consumption information and the time amount together as consumed electric energy information. The second control portion 360 may store the measured values (voltage and current) directly in the second storage portion 370 instead of the electric power consumption information and the consumed electric energy information. The second control portion 360 transmits the generated consumed electric energy information to the first control portion 310.

The first storage portion 320 may store, as the result of sampling, the measured values (voltage and current), the electric power consumption information, the time information, the time amount, the consumed electric energy information, and the like. Similarly, the second storage portion 370 may store, as the result of sampling, the measured values (voltage and current), the electric power consumption information, the time information, the time amount, the consumed electric energy information, and the like.

In this embodiment, the image forming apparatus 1 includes the second storage portion 370 separately from the first storage portion 320. However, the present invention is not limited thereto. The first storage portion 320 and the second storage portion 370 may be formed as a single storage portion. For example, the second storage portion 370 may be omitted and the first storage portion 320 may store, as the result of sampling, the voltage, the current, the electric power consumption information, the time information, the time amount, and the consumed electric energy information from the second control portion 360.

Next, operations of the environmental heater 450 will be described.

The environmental heater 450 heats an object to be heated (for example, sheet feeding cassette 414) provided in the image forming apparatus 1. A temperature sensor (not shown) detects the temperature of the object to be heated or its ambient temperature during a period in which the second AC cable 111 is plugged into the socket. The engine control portion 410 performs ON/OFF control on the commercial power source for the environmental heater 450 based on the detection value of the temperature sensor (not shown) so that the temperature of the object to be heated or its ambient temperature becomes a certain predetermined temperature.

The engine control portion 410 may be configured so as not to perform ON/OFF control on the commercial power source for the environmental heater 450 and the temperature sensor (not shown) which detects the temperature of the object to be heated or its ambient temperature may be omitted. The environmental heater 450 may be a heating element that generates heat with the direct supply of electric power from the commercial power source to heat the object to be heated.

Next, processing of generating consumed electric energy information of each operation mode of the image forming apparatus 1 according to the fourth embodiment will be described.

The operations in the plurality of operation modes (rising mode, copy mode, print mode, scan mode, standby mode, and sleep mode) of the image forming apparatus 1 according to the fourth embodiment are the same as the operations according to the above-mentioned first embodiment, and description thereof is therefore omitted herein.

The first control portion 310 and the second control portion 360 each generate consumed electric energy information.

In the operation mode other than the sleep mode, the first control portion 310 samples the measured values of the first electric power meter 100 in a predetermined cycle. The first control portion 310 generates, using the sampled measured values, the consumed electric energy information of the electric power consumption of the electric power that is supplied via the first AC cable 101 to the image forming apparatus 1.

In the sleep mode, the first control portion 310 does not sample the measured values of the first electric power meter 100. The first control portion 310 generates, using predicted electric power information prestored in the first storage portion 320, the consumed electric energy information of the electric power consumption of the electric power that is supplied via the first AC cable 101 to the image forming apparatus 1. The predicted electric power information of the sleep mode is prestored in the first storage portion 320 at the time of factory shipment of the image forming apparatus 1.

As described above, the first control portion 310 performs the same processing as the processing of generating consumed electric energy information that is described in the above-mentioned first embodiment (FIG. 3), and description thereof is therefore omitted herein.

Note that, after the first control portion 310 generates and updates the consumed electric energy information of each operation mode (corresponding to S114 of FIG. 3), the first control portion 310 receives, from the second control portion 360, the consumed electric energy information generated by the second control portion 360. The first control portion 310 sums the consumed electric energy information generated by the first control portion 310 and the consumed electric energy information generated by the second control portion 360, to thereby generate consumed electric energy information of the entire image forming apparatus 1.

In the operation mode other than the sleep mode, the second control portion 360 samples the measured values of the second electric power meter 110 in a predetermined cycle. The second control portion 360 generates, using the sampled measured values, the consumed electric energy information of the electric power consumption of the electric power that is supplied via the second AC cable 111 to the image forming apparatus 1.

In the sleep mode, the second control portion 360 samples the measured values (voltage and current) of the second electric power meter 110 the predetermined number of times (for example, once) after the predetermined period of time Δt (for example, 5 seconds) has elapsed since the start of the sleep mode. The second control portion 360 computes the electric power consumption information based on the sampled measured values, and stores the computed electric power consumption information in the second storage portion 370. After that, the second control portion 360 does not perform the sampling until the sleep mode is cancelled (ended). After the sleep mode is changed to another operation mode, the second control portion 360 generates, using the electric power consumption information stored in the second storage portion 370, the consumed electric energy information of the electric power consumption of the electric power that is supplied via the second AC cable 111 to the image forming apparatus 1.

As described above, the second control portion 360 performs the same processing as the processing of generating consumed electric energy information that is described in the above-mentioned second embodiment (FIG. 6), and description thereof is therefore omitted herein.

Note that, after the second control portion 360 generates and updates the consumed electric energy information of each operation mode (corresponding to S217 of FIG. 6), the second control portion 360 transmits the generated consumed electric energy information to the first control portion 310.

The first control portion 310 sums the consumed electric energy information of the first control portion 310 and the consumed electric energy information of the second control portion 360, to thereby generate the consumed electric energy information of each operation mode.

The first control portion 310 stores, in the first storage portion 320, for example, information of the items illustrated in FIG. 4 together with the consumed electric energy information of each operation mode that is obtained through the above-mentioned processing. Similarly to the first embodiment, the display of the consumed electric energy information of the image forming apparatus 1 as illustrated in FIG. 4 is performed regularly or when a command is received from the user. The user can be notified of the consumed electric energy information of the image forming apparatus 1 through the display on the operation display portion 330 or printing by the image forming portion 420. Further, the consumed electric energy information of the image forming apparatus 1 may be transmitted to the external apparatus via the I/F portion 340 or the communication portion 350.

In this embodiment, in the sleep mode, the first control portion 310 generates, using the predicted electric power information stored in the first storage portion 320, the consumed electric energy information of the electric power consumption of the electric power that is supplied via the first AC cable 101. In the sleep mode, the first control portion 310 does not sample the measured values of the first electric power meter 100.

In the sleep mode, the second control portion 360 samples the measured values of the second electric power meter 110 the predetermined number of times after the predetermined period of time has elapsed since the start of the sleep mode.

The second control portion 360 computes the electric power consumption information based on the sampled measured values, and stores the computed electric power consumption information in the second storage portion 370. After the sampling of the predetermined number of times, the second control portion 360 does not sample the measured values of the second electric power meter 110 until the sleep mode is changed to another operation mode. When the sleep mode is changed to another operation mode, the second control portion 360 generates, based on the electric power consumption information stored in the second storage portion 370, the consumed electric energy information of the electric power consumption of the electric power in the sleep mode that is supplied via the second AC cable 111. The second control portion 360 transmits the generated consumed electric energy information to the first control portion 310.

The first control portion 310 computes the consumed electric energy information of the sleep mode of the image forming apparatus 1 based on the consumed electric energy information generated by the first control portion 310 and the consumed electric energy information generated by the second control portion 360. Accordingly, in this embodiment, also in the image forming apparatus including the two AC cables, electric power to be required for executing the conventional processing that has been performed in the sleep mode by the control portion (that is, sampling in a predetermined cycle) can be reduced.

Note that, in this embodiment, the first control portion 310 performs the same processing as the processing of generating consumed electric energy information that is described in the above-mentioned first embodiment (FIG. 3). However, the present invention is not limited thereto. For example, the first control portion 310 may perform the processing of the above-mentioned second embodiment (FIG. 6) or the processing of the above-mentioned third embodiment (FIGS. 8A and 8B).

Figure 6:
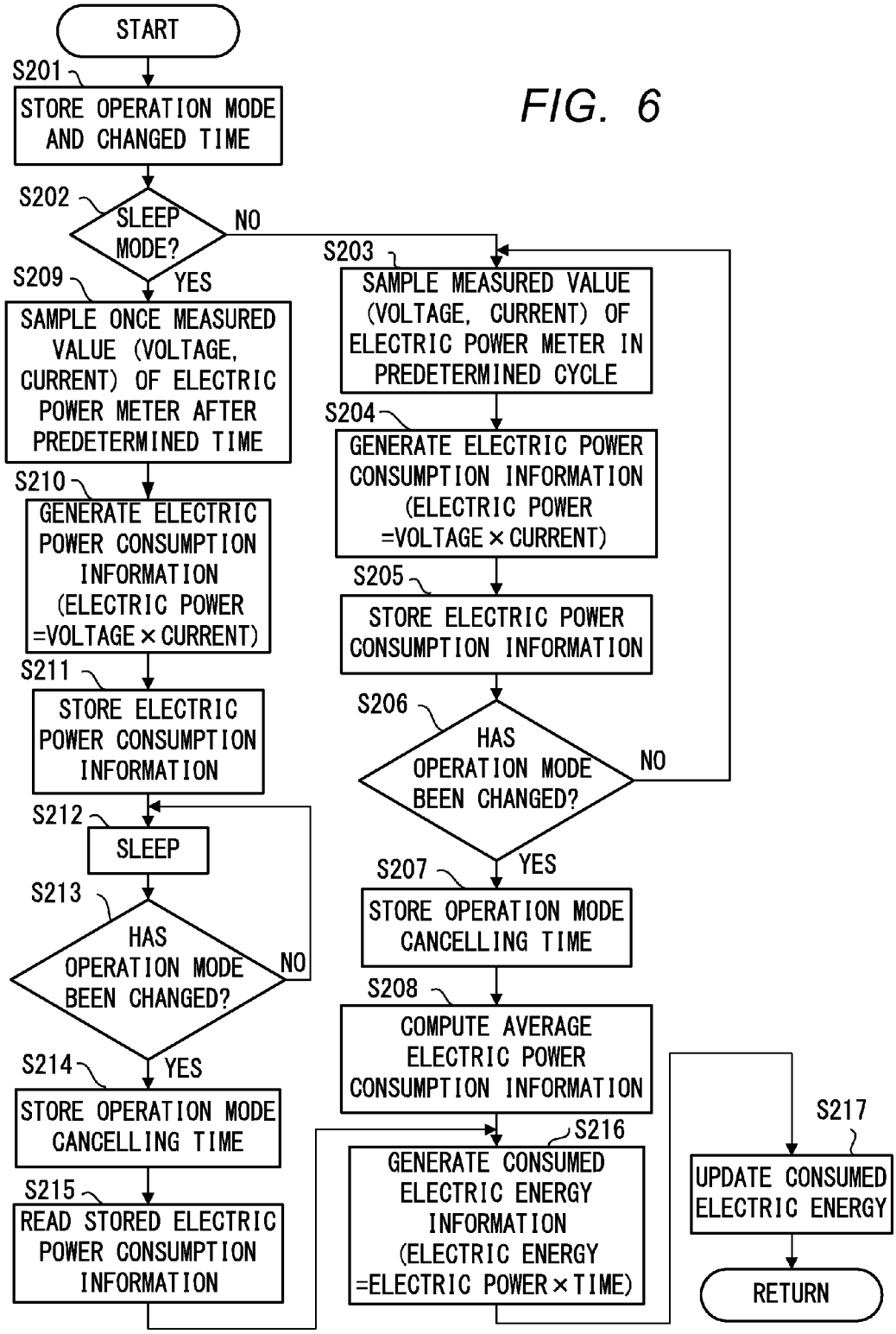
FIG. 6 is a flow chart illustrating an example of processing of generating consumed electric energy information of each operation mode of the image forming apparatus according to the second embodiment.

Similarly, in this embodiment, the second control portion 360 performs the same processing as the processing of generating consumed electric energy information that is described in the above-mentioned second embodiment (FIG. 6). However, the present invention is not limited thereto. For example, the second control portion 360 may perform the processing of the above-mentioned first embodiment (FIG. 3) or the processing of the above-mentioned third embodiment (FIGS. 8A and 8B).

In a case where the second control portion 360 performs the same processing as the processing of the first embodiment (FIG. 3), at the time of factory shipment, the predicted electric power information of the sleep mode may be prestored in the first storage portion 320, the second storage portion 370, or both of the first storage portion 320 and the second storage portion 370.

Alternatively, the second control portion 360 may sample the measured values of the second electric power meter 110 in a predetermined cycle in every operation mode irrespective of whether or not the operation mode is the sleep mode and generate, based on the result, the consumed electric energy information of each operation mode.

In this case, the processing of the second control portion 360 is the same as the processing executed by the control portion 310 in the "operation mode other than the sleep mode" according to the first embodiment. Specifically, the processing of the second control portion 360 is the same as the processing of S101, the loop of "NO" in S102, S103, S104, S105, S106, S107, S108, S113, and S114 of FIG. 3 according to the first embodiment.

The electric power saving mode is not limited to the sleep mode, and may be another operation mode in which no control is performed on the temperature of the fixing device 411.

According to this embodiment, in the image forming apparatus having at least one kind of electric power saving mode, in which the consumed electric energy information is to be generated, the consumed electric energy to be required for the sampling of the measured values of the electric power consumption can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-283479, filed Dec. 20, 2010, which is hereby incorporated by reference herein in its entirety.

What is claimed is:

1. An image forming apparatus having an active mode of performing image formation and an electric power saving mode of reducing electric power consumption, the image forming apparatus comprising:

an electric power measuring portion configured to measure the electric power consumption of the image forming apparatus;

a storage portion configured to store electric power consumption information per unit time of the image forming apparatus in the electric power saving mode;

a control portion configured to determine, based on the electric power consumption measured by the electric power measuring portion, consumed electric energy of the image forming apparatus during a period in which the image forming apparatus is in the active mode, and determine, based on a length of period in which the image forming apparatus is in the electric power saving mode and the electric power consumption information stored in the storage portion, consumed electric energy of the image forming apparatus during the period in which the image forming apparatus is in the electric power saving mode;

a first electric supply line configured to supply electric power to the image forming apparatus via the electric power measuring portion;

a second electric supply line configured to supply electric power to the image forming apparatus;

a second electric power measuring portion configured to measure electric power consumption of the electric power of the image forming apparatus that is supplied via the second electric supply line and output a measured value; and a second control portion configured to sample the measured value of the second electric power measuring portion and output a result of sampling, wherein the storage portion stores a result of sampling of the control portion and the result of sampling of the second control portion, wherein the second control portion in the active mode samples the measured value of the second electric power measuring portion in a predetermined cycle, and determines consumed electric energy of the active mode based on a result of sampling, wherein the second control portion in the electric power saving mode performs one of:

sampling the measured value of the second electric power measuring portion in the predetermined cycle, and determining consumed electric energy of the electric power saving mode based on a result of sampling;

determining the consumed electric energy of the electric power saving mode based on the electric power consumption information stored in the storage portion without sampling the measured value of the second electric power measuring portion; and sampling the measured value of the second electric power measuring portion a predetermined number of times, which is smaller than a number of sampling times in the active mode, after a predetermined period of time has elapsed since the start of the electric power saving mode, storing a result of sampling in the storage portion, and thereafter generating the consumed electric energy of the electric power saving mode based on the result of sampling stored in the storage portion without sampling the measured value until the electric power saving mode is ended, and wherein the control portion determines the consumed electric energy of the image forming apparatus based on the consumed electric energy of the control portion and the consumed electric energy of the second control portion.

2. An image forming apparatus according to claim 1, wherein the control portion, in the active mode, samples a measured value of the electric power measuring portion in a predetermined cycle, and determines the consumed electric energy based on a result of sampling, and wherein the control portion, in the electric power saving mode, determines the consumed electric energy without sampling the measured value of the electric power measuring portion.

3. An image forming apparatus according to claim 1, wherein the electric power consumption information is prestored in the storage portion.

4. An image forming apparatus according to claim 1, wherein the electric power measuring portion includes a current measuring portion configured to measure a current and a voltage measuring portion configured to measure a voltage, and measures the electric power consumption based on the current measured by the current measuring portion and the voltage measured by the voltage measuring portion.

5. An image forming apparatus according to claim 1, further comprising:

a fixing device configured to fix a developer image on a recording material;

a heater configured to heat the fixing device; and a heater driving portion configured to drive the heater, wherein the electric power saving mode comprises an operation mode of making electric power consumption of the heater driving portion less than the electric power consumption thereof in the active mode.

6. An image forming apparatus according to claim 1, further comprising a display portion configured to display information on the consumed electric energy of the image forming apparatus.

7. An image forming apparatus according to claim 1, further comprising a communication portion configured to transmit information on the consumed electric energy of the image forming apparatus to an external apparatus.

8. An image forming apparatus according to claim 1, wherein the storage portion comprises:

a first storage portion configured to store the result of sampling of the control portion; and a second storage portion configured to store the result of sampling of the second control portion, and wherein the electric power consumption information is prestored in the first storage portion, the second storage portion, or both of the first storage portion and the second storage portion.

9. An image forming apparatus according to claim 1, wherein the second electric supply line supplies the electric power to a heater configured to heat a sheet feeding cassette that contains a recording material on which an image is to be formed by the image forming apparatus.

10. An image forming apparatus having an active mode of performing image formation and an electric power saving mode of reducing electric power consumption, the image forming apparatus comprising:

an electric power measuring portion configured to measure the electric power consumption of the image forming apparatus and output a measured value;

a control portion configured to sample the measured value of the electric power measuring portion and output a result of sampling; and a storage portion configured to store the result of sampling, wherein the control portion, in the active mode, samples the measured value of the electric power measuring portion in a predetermined cycle, and determines consumed electric energy of the active mode based on a result of sampling, and wherein the control portion, in the electric power saving mode, samples the measured value of the electric power measuring portion a predetermined number of times, which is smaller than a number of sampling times of the measured value in the active mode, after a predetermined period of time has elapsed since the start of the electric power saving mode, stores a result of sampling in the storage portion, and thereafter determines consumed electric energy of the electric power saving mode based on the result of sampling stored in the storage portion without sampling the measured value until the electric power saving mode is ended.

11. An image forming apparatus according to claim 10, wherein, in a first electric power saving mode after a main power source of the image forming apparatus is turned ON, the control portion samples the measured value of the electric power measuring portion the predetermined number of times after the predetermined period of time has elapsed since the start of the first electric power saving mode, stores a result of sampling in the storage portion, and thereafter determines the consumed electric energy of the first electric power saving mode based on the result of sampling stored in the storage portion without sampling the measured value until the first electric power saving mode is ended, and wherein, in a second electric power saving mode and a subsequent electric power saving mode after the main power source of the image forming apparatus is turned ON, the control portion determines the consumed electric energy of the second electric power saving mode and the subsequent electric power saving mode based on the result of sampling in the first electric power saving mode, which is stored in the storage portion, without sampling the measured value of the electric power measuring portion.

12. An image forming apparatus according to claim 10, wherein the predetermined number of times is smaller than the number of sampling times in a case where the measured value is sampled in the predetermined cycle within the predetermined period of time in the active mode.

13. An image forming apparatus according to claim 10, wherein the result of sampling comprises the measured value or electric power consumption information obtained based on the measured value.

14. An image forming apparatus according to claim 10, wherein the electric power measuring portion measures a current and a voltage.

15. An image forming apparatus according to claim 10, further comprising:

a fixing device configured to fix a developer image on a recording material;

a heater configured to heat the fixing device; and a heater driving portion configured to drive the heater, wherein the electric power saving mode comprises an operation mode of making electric power consumption of the heater driving portion less than the electric power consumption of the heater driving portion in the active mode.

16. An image forming apparatus according to claim 10, further comprising a display portion configured to display information on the consumed electric energy of the image forming apparatus.

17. An image forming apparatus according to claim 10, further comprising a communication portion configured to transmit information on the consumed electric energy of the image forming apparatus to an external apparatus.

18. An image forming apparatus according to claim 10, further comprising:

a first electric supply line configured to supply electric power to the image forming apparatus via the electric power measuring portion;

a second electric supply line configured to supply electric power to the image forming apparatus;

a second electric power measuring portion configured to measure electric power consumption of the electric power of the image forming apparatus that is supplied via the second electric supply line and output a measured value; and a second control portion configured to sample the measured value of the second electric power measuring portion and output a result of sampling, wherein the storage portion stores the result of sampling of the second control portion, wherein the second control portion, in the active mode, samples the measured value of the second electric power measuring portion in the predetermined cycle, and determines consumed electric energy of the active mode based on a result of sampling, wherein the second control portion in the electric power saving mode performs one of:

sampling the measured value of the second electric power measuring portion in the predetermined cycle, and determining consumed electric energy of the electric power saving mode based on a result of sampling; and sampling the measured value of the second electric power measuring portion the predetermined number of times after the predetermined period of time has elapsed since the start of the electric power saving mode, storing a result of sampling in the storage portion, and thereafter determining the consumed electric energy of the electric power saving mode based on the result of sampling stored in the storage portion without sampling the measured value until the electric power saving mode is ended, and wherein the control portion determines the consumed electric energy of the image forming apparatus based on the consumed electric energy of the control portion and the consumed electric energy of the second control portion.

19. An image forming apparatus according to claim 18, wherein the second electric supply line supplies the electric power to a heater configured to heat a sheet feeding cassette that contains a recording material on which an image is to be formed by the image forming apparatus.

20. An image forming apparatus having an active mode of performing image formation and an electric power saving mode of reducing electric power consumption, the image forming apparatus comprising:

an electric power measuring portion configured to measure the electric power consumption of the image forming apparatus and output a measured value;

a control portion configured to sample the measured value of the electric power measuring portion and output a result of sampling; and a storage portion configured to store the result of sampling, wherein the control portion, in the active mode, samples the measured value of the electric power measuring portion in a predetermined cycle, and determines consumed electric energy of the active mode based on a result of sampling, and wherein the control portion, in the electric power saving mode, samples the measured value of the electric power measuring portion a predetermined number of times after the start of the electric power saving mode, stores a result of sampling of the predetermined number of times in the storage portion, thereafter does not sample output of the electric power measuring portion until the electric power saving mode is ended, and determines, based on a length of period in which the image forming apparatus is in the electric power saving mode and the result of sampling of the predetermined number of times stored in the storage portion, consumed electric energy of the image forming apparatus during the period in which the image forming apparatus is in the electric power saving mode.

21. An image forming apparatus according to claim 20, wherein the electric power measuring portion includes a current measuring portion configured to measure a current and a voltage measuring portion configured to measure a voltage, and measures the electric power consumption based on the current measured by the current measuring portion and the voltage measured by the voltage measuring portion.

22. An image forming apparatus according to claim 20, further comprising:

a fixing device configured to fix a developer image on a recording material;

a heater configured to heat the fixing device; and a heater driving portion configured to drive the heater, wherein the electric power saving mode comprises an operation mode of making electric power consumption of the heater driving portion less than the electric power consumption thereof in the active mode.

23. An image forming apparatus according to claim 20, further comprising a display portion configured to display information on the consumed electric energy of the image forming apparatus.

24. An image forming apparatus according to claim 20, further comprising a communication portion configured to transmit information on the consumed electric energy of the image forming apparatus to an external apparatus.

25. An image forming apparatus according to claim 20, wherein, in a first electric power saving mode after a main power source of the image forming apparatus is turned ON, the control portion samples output of the electric power measuring portion the predetermined number of times, and wherein, in a second electric power saving mode and a subsequent electric power saving mode after the main power source of the image forming apparatus is turned ON, the control portion does not sample output of the electric power measuring portion and determines, based on the output of the electric power measuring portion sampled in the first electric power saving mode and a length of period of the second and subsequent electric power saving modes, consumed electric energy in the second and subsequent electric power saving modes.

* * * * *